US008528210B2

(12) United States Patent
Holmes et al.

(10) Patent No.: US 8,528,210 B2
(45) Date of Patent: Sep. 10, 2013

(54) UNIVERSAL MAGNET ROLLER PRESS APPARATUS, ASSEMBLY, AND METHOD

(75) Inventors: Denny Holmes, Los Angeles, CA (US); Tigran Ohanyan, Van Nuys, CA (US)

(73) Assignee: Mitsubishi Kagaku Imaging Corporation, San Fernando, CA (US)

( * ) Notice: Subject to any disclaimer, the term of this patent is extended or adjusted under 35 U.S.C. 154(b) by 536 days.

(21) Appl. No.: 12/806,717

(22) Filed: Aug. 18, 2010

(65) Prior Publication Data

US 2011/0044721 A1 Feb. 24, 2011

Related U.S. Application Data

(60) Provisional application No. 61/274,617, filed on Aug. 18, 2009, provisional application No. 61/283,254, filed on Nov. 30, 2009.

(51) Int. Cl.
*B21D 53/00* (2006.01)
*B41F 1/34* (2006.01)

(52) U.S. Cl.
USPC ..... 29/895.1; 29/450; 101/480

(58) Field of Classification Search
USPC ..... 101/480; 29/450, 895.1
See application file for complete search history.

(56) References Cited

U.S. PATENT DOCUMENTS

| | | | | |
|---|---|---|---|---|
| 3,061,914 | A * | 11/1962 | Johnston | 29/234 |
| 3,541,665 | A * | 11/1970 | Ferris, Sr. | 29/895.1 |
| 4,763,394 | A * | 8/1988 | Decato et al. | 29/252 |
| 5,638,754 | A * | 6/1997 | Steinmeier et al. | 101/477 |
| 6,131,261 | A * | 10/2000 | Michlin | 29/251 |
| 6,321,048 | B1 * | 11/2001 | Michlin | 399/90 |
| 6,463,648 | B2 * | 10/2002 | Gottling et al. | 29/426.1 |
| 6,876,827 | B1 * | 4/2005 | Michlin | 399/90 |
| 7,331,288 | B2 * | 2/2008 | Gottling et al. | 101/480 |

* cited by examiner

*Primary Examiner* — David Bryant
*Assistant Examiner* — Jacob Cigna

(57) ABSTRACT

There is provided a universal magnet roller press apparatus, assembly, and method for removing and installing a magnet and a hub of a magnet roller of a toner printer cartridge. The apparatus has a mounting base, a screw drive assembly, an alignment cradle, a front support assembly, a back support assembly, and a first rod stop and a second rod stop. The assembly has the universal magnet roller press apparatus and a plurality of magnet roller adaptors for attached to the magnet roller during removal and installation of the magnet and the hub.

10 Claims, 33 Drawing Sheets

10
11
12
14
16
17
18
19
22
24
26
28
29
30
31a
31b
31c
31d
32
34
38
40
42
44
48
50
54
56
60
62
64

UNIVERSAL MAGNET ROLLER PRESS APPARATUS, ASSEMBLY, AND METHOD

CROSS REFERENCE TO RELATED APPLICATIONS

This application claims the benefit of U.S. Provisional Patent Application Ser. No. 61/274,617, filed Aug. 18, 2009, which is incorporated herein by reference in its entirety, and also claims the benefit of U.S. Provisional Patent Application Ser. No. 61/283,254, filed Nov. 30, 2009, which is incorporated herein by reference in its entirety.

STATEMENT RE: FEDERALLY SPONSORED RESEARCH/DEVELOPMENT (Not Applicable)

FIELD

The disclosure relates to electrophotography, particularly an apparatus and methods for remanufacturing toner printer cartridges.

BACKGROUND

Used printer cartridges of fax machines, copiers, inkjet printers, and laser printers are often remanufactured. Such printer cartridges typically include a toner hopper, a waste hopper, a primary charge roller, a magnet roller, and a drum. The magnet roller ("magnet roller" or "mag roller") or magnet sleeve generally comprises a coated aluminum sleeve rotating around a stationary magnet. The magnet roller attracts toner which is held onto the sleeve by the inner magnet. The magnet roller is usually one of the components that wears out from usage and gets replaced during remanufacturing. It is desirable to be able to take apart the magnet roller in order to replace the magnet sleeve, re-use the inner magnet, and not damage the inner magnet or magnet roller hub. For purposes of this application, a magnet roller hub is a pressed-in retaining flange for the inner magnet. Known devices exist for taking apart magnet rollers but such known devices may not properly align the magnet roller in place and can damage the magnet roller hub and the inner magnet by excessive pushing on the magnet end of the magnet roller.

In addition, it is desirable to be able to re-use the inner magnet with a variety of magnet roller sizes and hub adaptors. Such known devices for taking apart magnet rollers do not provide for universal magnet roller adaptors.

Accordingly, there is a need for a universal magnet roller apparatus, assembly, and method that overcomes the issues of known devices.

SUMMARY

This need for a universal magnet roller apparatus, assembly, and method is satisfied. The disclosure provides for a universal magnet roller press apparatus and method that includes a screw drive assembly, a front support assembly, and a back support assembly; allows one to easily retain the magnet roller in a secure position where the inner magnet of the magnet roller can be easily pushed out or removed without damage to the inner magnet; allows for the proper alignment of a magnet roller when the magnet roller is disassembled and reassembled; and, allows for use of the magnet roller with a variety of universal magnet roller adaptors.

In one embodiment there is provided a universal magnet roller press apparatus for removing and installing a magnet and a hub of a magnet roller of a toner printer cartridge. The apparatus comprises a mounting base. The apparatus further comprises screw drive assembly attached to a first top end of the mounting base. The apparatus further comprises an alignment cradle attached to a top portion of the mounting base adjacent the screw drive assembly. The apparatus further comprises a front support assembly attached to the top portion of the mounting base adjacent the alignment cradle. The apparatus further comprises a back support assembly attached to a second top end of the mounting base and spaced apart from the front support assembly. The apparatus further comprises a first rod stop and a second rod stop attached to sides of the mounting base for adjusting a position of the back support assembly.

In another embodiment there is provided a universal magnet roller press assembly for removing and installing a magnet and a hub of a magnet roller of a toner printer cartridge. The assembly comprises a universal magnet roller press apparatus. The apparatus comprises a mounting base. The apparatus further comprises screw drive assembly attached to a first top end of the mounting base. The apparatus further comprises an alignment cradle attached to a top portion of the mounting base adjacent the screw drive assembly. The apparatus further comprises a front support assembly attached to the top portion of the mounting base adjacent the alignment cradle. The apparatus further comprises a back support assembly attached to a second top end of the mounting base and spaced apart from the front support assembly. The apparatus further comprises a first rod stop and a second rod stop attached to sides of the mounting base for adjusting a position of the back support assembly. The assembly further comprises one or more magnet roller adaptors for attachment to the magnet roller during removal and installation of the magnet and the hub.

In another embodiment there is provided a method for removing and installing a magnet and a hub of a magnet roller of a toner printer cartridge. The method comprises using a universal magnet roller assembly to remove the magnet and the hub from the magnet roller. The method further comprises using the universal magnet roller assembly to install the removed magnet and the removed hub into a replacement magnet sleeve to form a remanufactured magnet roller.

In another embodiment there is provided a method for remanufacturing a magnet roller of a toner printer cartridge. The method comprise providing a magnet roller having a first end, a second end, a hub attached at the first end, a magnet sleeve, and an inner magnet. The method further comprises coupling a first magnet roller adaptor to the first end of the magnet roller. The method further comprises providing a universal magnet roller press comprising a screw drive assembly having a revolving handle and a push rod, a front support assembly, and a back support assembly. The method further comprises positioning and aligning the magnet roller in the front support assembly and the back support assembly of the universal magnet roller press apparatus. The method further comprises using the screw drive assembly to push the inner magnet and the hub out of the magnet sleeve. The method further comprises removing the first magnet roller adaptor. The method further comprises discarding the magnet sleeve. The method further comprises inserting the removed inner magnet and the removed hub into a replacement magnet sleeve having a first end and a second end. The method further comprises coupling a second magnet roller adaptor to the first end of the replacement magnet sleeve and coupling a third magnet roller adaptor to the second end of the replacement magnet sleeve. The method further comprises positioning and aligning the replacement magnet sleeve in the front support assembly and the back support assembly of the universal magnet roller press apparatus. The method further comprises using the screw drive assembly to attach the removed inner magnet and the removed hub to the replacement magnet sleeve to form a remanufactured magnet roller. The method further comprises removing the second magnet roller adaptor and the third magnet roller adaptor from the remanufactured magnet roller.

In another embodiment there is provided a method for removing and installing a magnet and a hub of a magnet roller of a toner printer cartridge used in electrophotographic image forming devices. The method comprises removing a magnet and a hub from a magnet roller by positioning and aligning the magnet roller in a universal magnet roller press apparatus, actuating with a revolving handle a push rod of a screw drive assembly to push the magnet and the hub out of a magnet sleeve, and discarding the magnet sleeve. The method further comprises installing the removed magnet and the removed hub into a replacement magnet sleeve by inserting the removed magnet and the removed hub into the replacement magnet sleeve, positioning and aligning the removed magnet and the removed hub within the replacement magnet sleeve in the universal magnet roller press apparatus, and actuating with the revolving handle the push rod of the screw drive assembly to push the removed magnet and the removed hub into the replacement magnet sleeve so that the removed magnet and the removed hub attach to the replacement magnet sleeve. The method further comprises removing the attached magnet roller from the apparatus.

The features, functions, and advantages that have been discussed can be achieved independently in various embodiments of the disclosure or may be combined in yet other embodiments further details of which can be seen with reference to the following description and drawings.

BRIEF DESCRIPTION OF THE DRAWINGS

The disclosure can be better understood with reference to the following detailed description taken in conjunction with the accompanying drawings which illustrate preferred and exemplary embodiments, but which are not necessarily drawn to scale, wherein.

DETAILED DESCRIPTION

Disclosed embodiments will now be described more fully herein after with reference to the accompanying drawings, in which some, but not all disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art. It is to be understood that other embodiments may be utilized and structural changes may be made without departing from the scope of the disclosure. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the disclosure.

Figure 1:
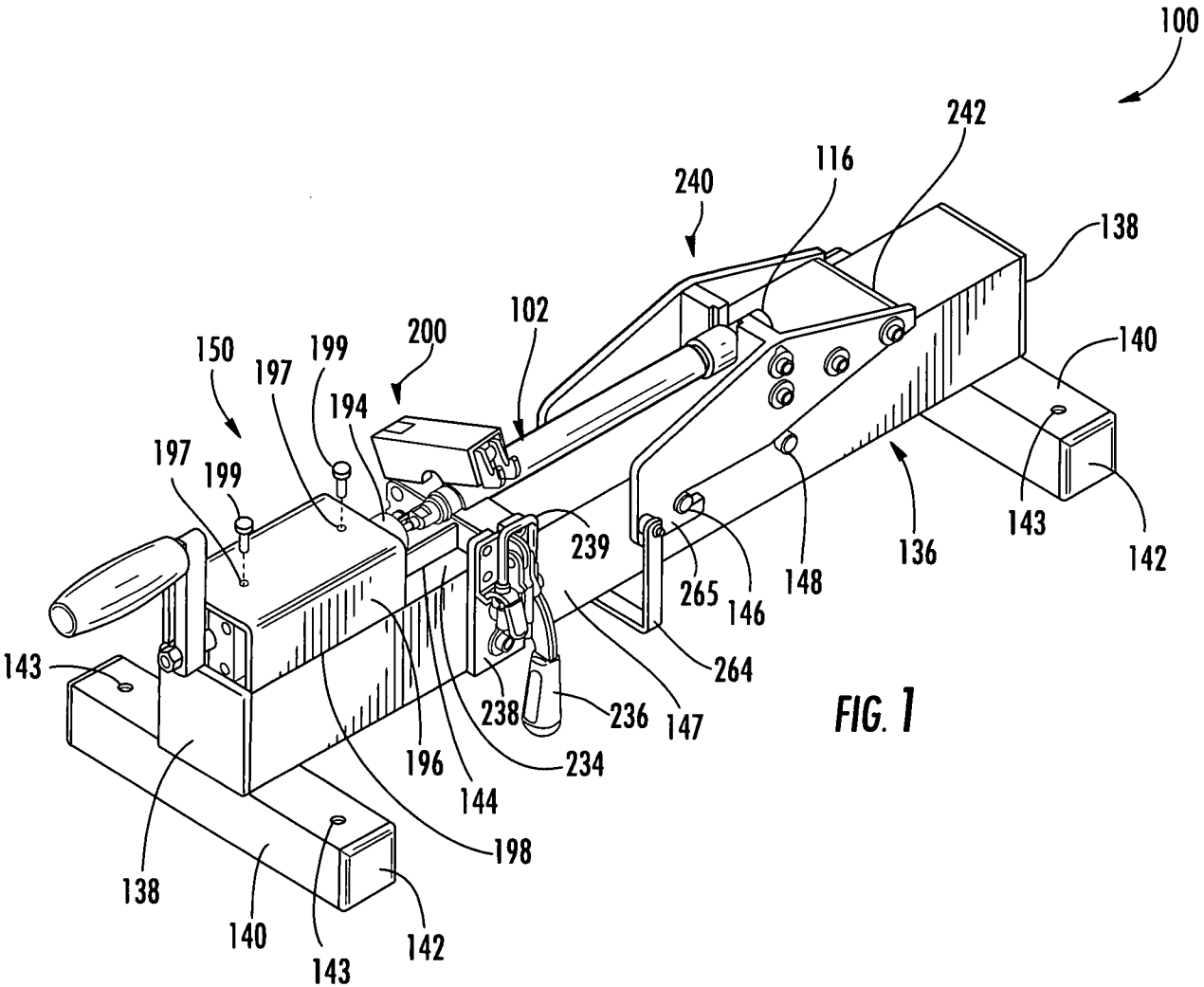
FIG. 1 is an illustration of a top, front right perspective view of one of the embodiments of the universal magnet roller press apparatus of the disclosure.
Figure 2:
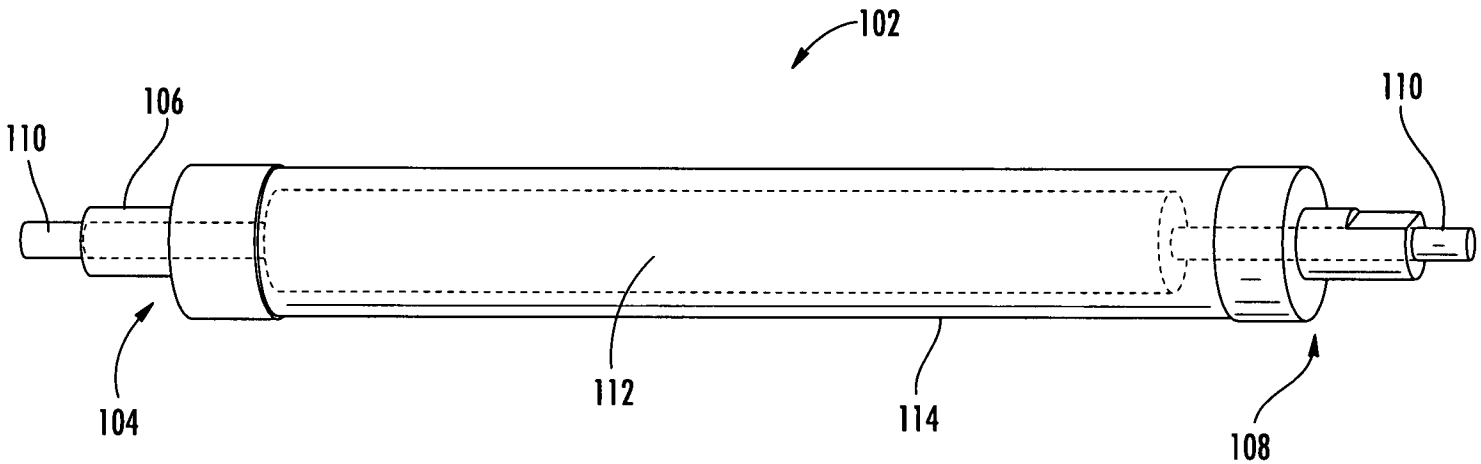
FIG. 2 (PRIOR ART)
FIG. 2 is an illustration of an existing magnet roller that may be used with one of the embodiments of the universal magnet roller press apparatus, assembly, and method of the disclosure.

FIG. 1 is an illustration of a top, front right perspective view of one of the embodiments of a universal magnet ("mag") roller press apparatus 100 of the disclosure. FIG. 2 is an illustration of an existing magnet roller 102 that may be used with one of the embodiments of the universal magnet roller press apparatus 100, assembly 101 (see FIGS. 4A-4B), and method 400 of the disclosure.

In one embodiment there is provided a universal magnet roller press apparatus 100 (see FIG. 1) or 10 (see FIG. 17A) for removing and installing a magnet 110 (see FIG. 2), preferably in the form of an inner magnet, and a hub 106 (see FIG. 2), of a magnet roller 102 (see FIG. 2) used with known toner printer cartridges (not shown). Referring to FIG. 1, the apparatus 100 comprises a mounting base 136 having end caps 138. Preferably, the mounting base 136 is comprised of steel. However, the mounting base 136 may also be made of other suitable materials. The mounting base 136 further comprises one or more end pieces or legs 140. Preferably, the mounting base 136 has two end pieces or legs 140. Each end piece or leg 140 preferably has end caps 142 and preferably has one or more mounting holes 143. When used, the apparatus 100 may preferably be mounted to a substantially flat surface (not shown) using one or more bolts 145 (see FIG. 16E) inserted through the mounting holes 143.

The apparatus 100 further comprises screw drive assembly 150 attached to a first top end 198 of the mounting base 136. As shown in FIG. 1, the screw drive assembly 150 comprises a housing cover 196 attached to the first top end 198 of the mounting base 136. The housing cover 196 may preferably have one or more openings 197 for insertion of a lubricant (not shown) for lubricating internal parts of the screw drive assembly 150. The openings 197 may be covered with removable plug elements 195.

The apparatus 100 further comprises an alignment cradle or block 144 attached to a top portion 234 of the mounting base 136 adjacent the screw drive assembly 150. The alignment cradle or block 144 may be comprised of felt, plastic, or another suitable material and is designed to cradle or hold the magnet roller 102 during the removal and installation process.

The apparatus 100 further comprises a front support assembly 200 attached to the top portion 234 of the mounting base 136 adjacent the alignment cradle or block 144. The front support assembly 200 may be locked and unlocked with a locking clamp handle 236 attached to a latch plate 238 and a U-hook 239. The latch plate 238 is attached to side 147 of the mounting base 136.

The apparatus further comprises a back support assembly 240 attached to a second top end 242 of the mounting base 136 and spaced apart from the front support assembly 200. The back support assembly 240 also includes a slide retainer bracket 264 attached to the back support assembly 240. The slide retainer bracket 264 is used to keep the back support assembly 240 aligned and to keep the back support assembly 240 from coming off the mounting base 136 when the back support assembly 240 is moved between a first rod stop 146 and a second rod stop 148. The apparatus 100 further comprises first rod stop 146 and a second rod stop 148 attached to sides 147 of the mounting base 136 for adjusting a position of the back support assembly 240. The first rod stop 146 and the second rod stop 148 are preferably in parallel alignment and are preferably spaced apart from each other. The first rod stop 146 is designed to be used when a magnet roller having a shorter length is positioned in the apparatus 100. The second rod stop 148 is designed to be used when a magnet roller having a longer length is positioned in the apparatus 100.

The universal magnet roller press apparatus 100 may be used with any number of existing magnet rollers such as existing magnet roller 102 (see FIG. 1). As shown in FIG. 1, the magnet roller 102 may be attached to magnet roller adaptor 194 at second end 108 (see FIG. 2) and to magnet roller adaptor 116 at first end 104 (see FIG. 2). As shown in FIG. 2, the magnet roller 102 has a first end 104 or non-drive end having a hub 106. The magnet roller 102 has a second end 108 or drive end. The magnet roller 102 comprises a magnet 110 having a shaft 112. The magnet roller 102 further comprises a magnet sleeve 114 that surrounds the shaft 112. The apparatus 100, 10 is used to remanufacture magnet rollers by removing a magnet 110 and a hub 106 from a magnet roller 102, preferably a worn magnet roller, and installing the magnet 110 and the hub 106 into a replacement sleeve 302 (see FIG. 16G) to form a remanufactured magnet roller 308 (see FIG. 16G).

Figure 3:
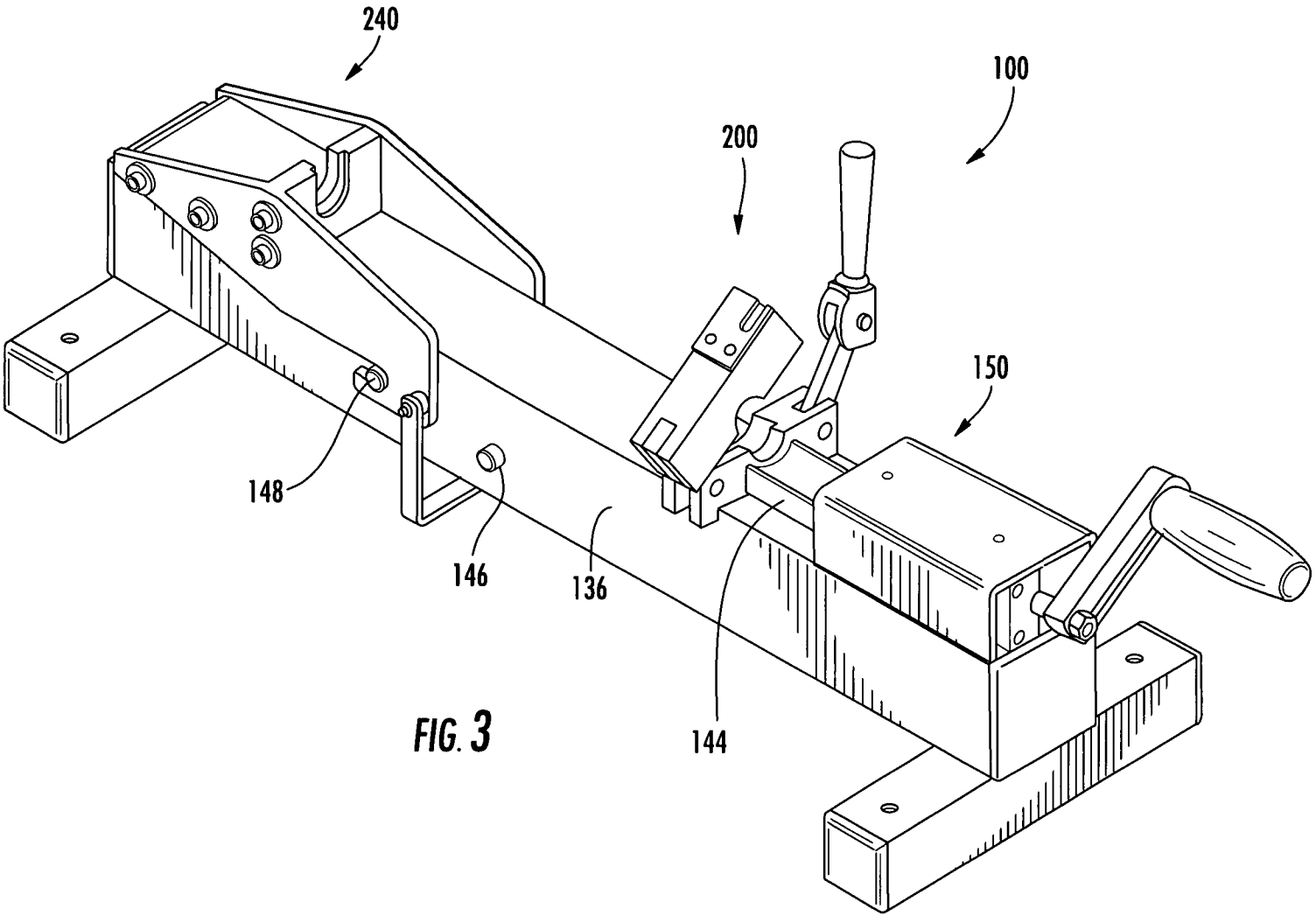
FIG. 3 is an illustration of a top, front left perspective view of one of the embodiments of the universal magnet roller press apparatus of the disclosure.

FIG. 3 is an illustration of a top, front left perspective view of the universal magnet roller press apparatus 100 of the disclosure. FIG. 3 shows the mounting base 136, the alignment cradle or block 144, the first rod stop 146, the second rod stop 148, the screw drive assembly 150, the front support assembly 200, and the back support assembly 240.

Figure 4A:
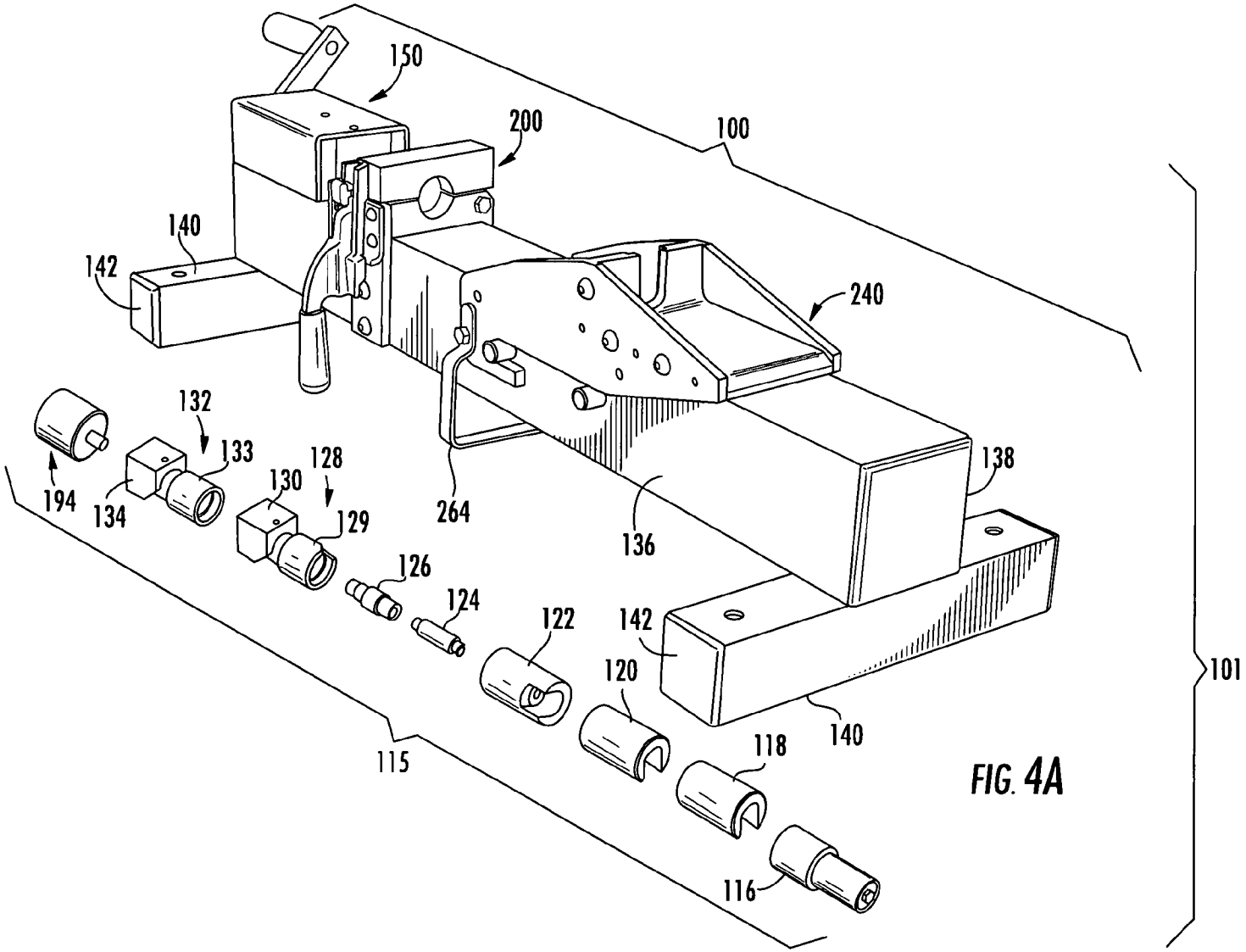
FIG. 4A is an illustration of a top, back perspective view of one of the embodiments of the universal magnet roller press apparatus of the disclosure.
Figure 4B:
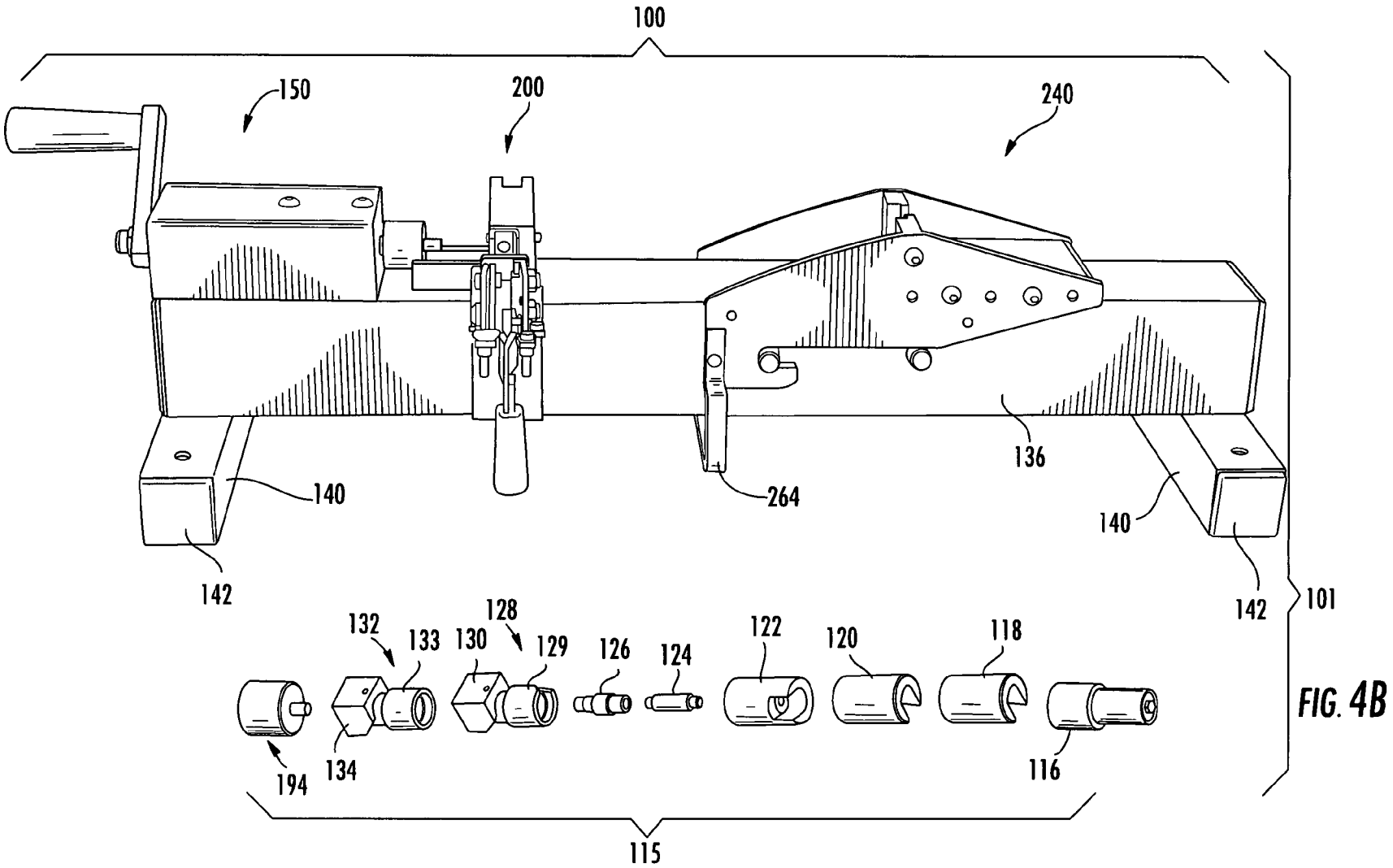
FIG. 4B is an illustration of a right side perspective view of the universal magnet roller press apparatus of FIG. 4A.

In another embodiment there is provided a universal magnet roller press assembly 101 for removing and installing a magnet 110 and a hub 106 of a magnet roller 102 of a toner printer cartridge. FIG. 4A is an illustration of a top, back perspective view of one of the embodiments of the universal magnet roller press assembly 101 of the disclosure. FIG. 4B is an illustration of a right side perspective view of the universal magnet roller press assembly 101 of FIG. 4A. The universal magnet roller press assembly 101 comprises the universal magnet roller press apparatus 100, as discussed above. The apparatus 100 comprises a mounting base 136. The apparatus 100 further comprises screw drive assembly 150 attached to a first top end 198 of the mounting base 136. The apparatus 100 further comprises an alignment cradle 144 attached to a top portion 234 of the mounting base 136 adjacent the screw drive assembly 150. The apparatus 100 further comprises a front support assembly 200 attached to the top portion 234 of the mounting base 136 adjacent the alignment cradle 144. The apparatus 100 further comprises a back support assembly 240 attached to a second top end 242 of the mounting base 136 and spaced apart from the front support assembly 200. The apparatus 100 further comprises a first rod stop 146 and a second rod stop 148 attached to sides 147 of the mounting base 136 for adjusting a position of the back support assembly 240. As shown in FIGS. 4A-4B, the apparatus 100 comprises the mounting base 136 with end cap 138, end pieces or legs 140 with end caps 142, the screw drive assembly 150, the front support assembly 200, and the back support assembly 240, and the slide retainer bracket 264.

Figure 14A:
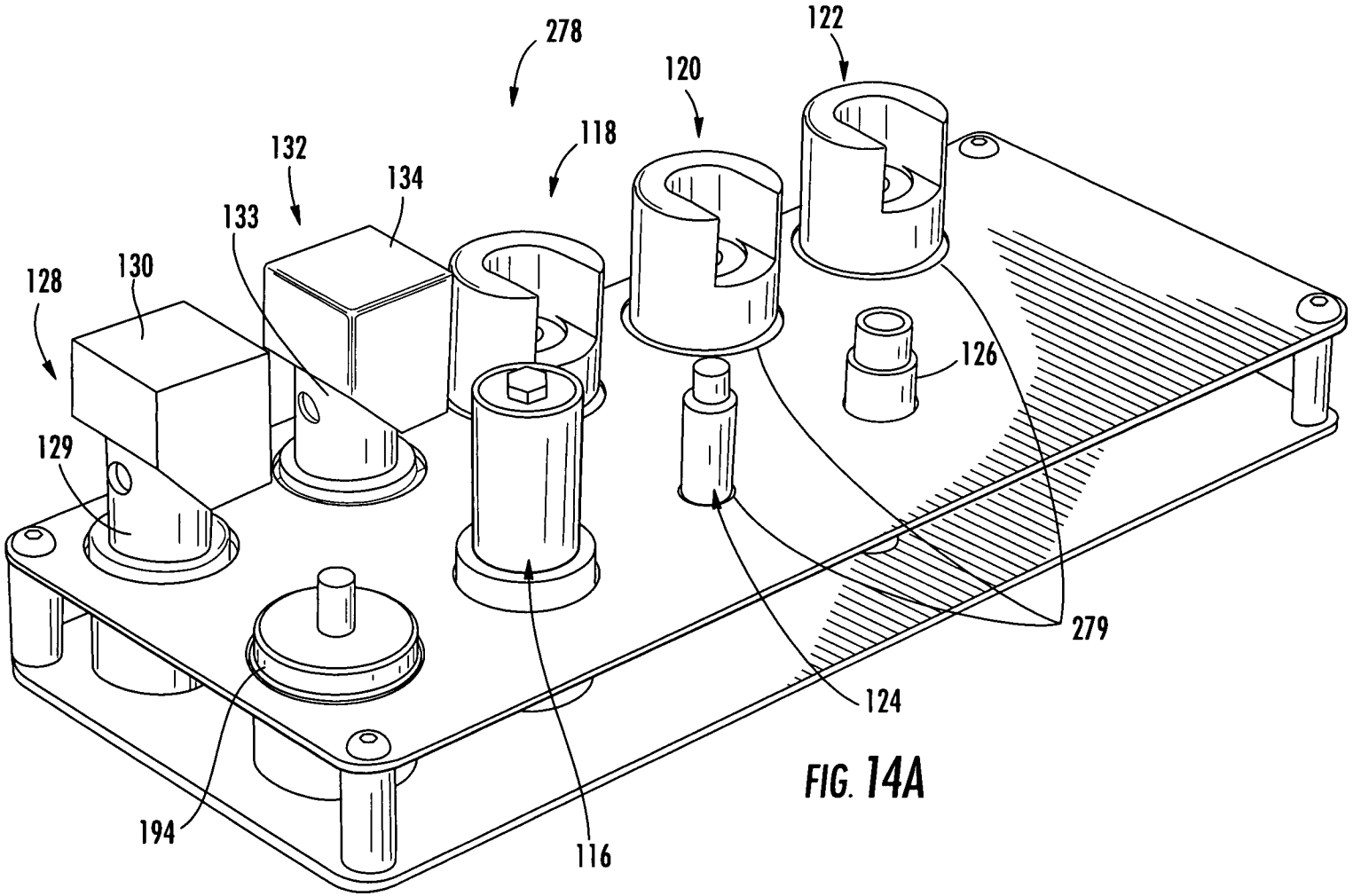
FIG. 14A is an illustration of a front perspective view of embodiments of adaptors for use with the universal magnet roller press apparatus of FIG. 1.
Figure 14B:
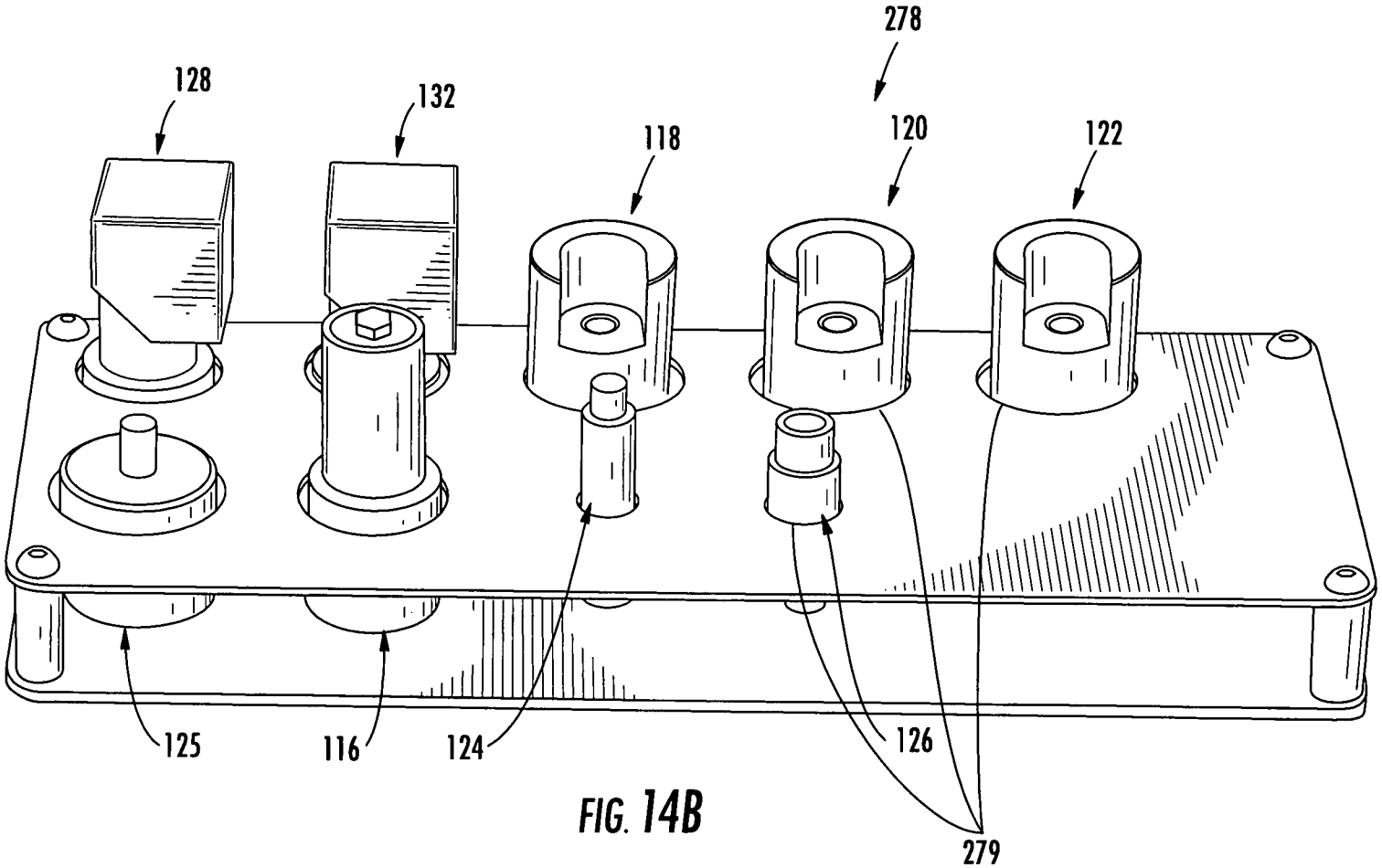
FIG. 14B is an illustration of a front view of the plurality of adaptors of FIG. 14A.
Figure 15G:
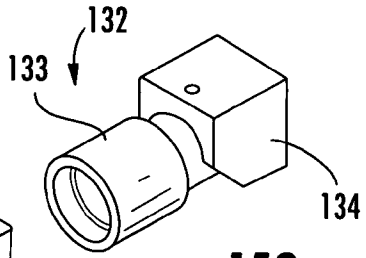
FIG. 15A-15I are illustrations of embodiments of adaptors for use with the universal magnet roller press apparatus of FIG. 1.
Figure 15F:
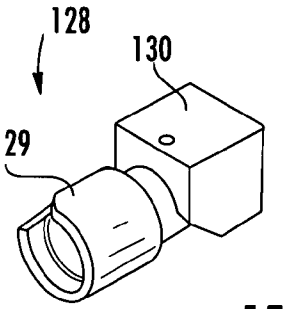
Figure 15E:
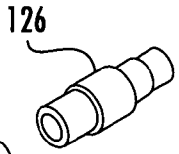
Figure 15D:
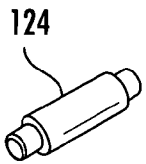
Figure 15C:
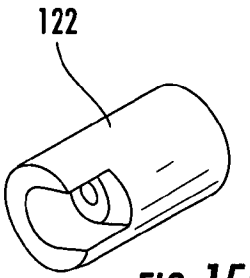
Figure 15B:
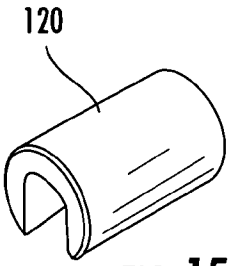
Figure 15A:
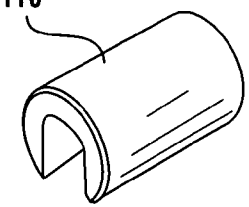
Figure 15I:
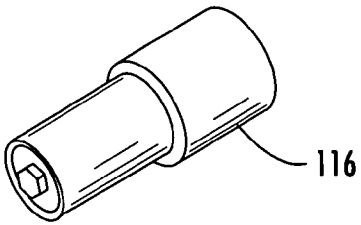
Figure 15H:
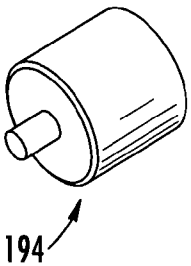

The assembly 101 further comprises one or more magnet roller adaptors 116, 118, 120, 122, 124, 126, 128, 132, and 194 for use with and attachment to the magnet roller 102 (see FIG. 2) during removal and installation of the magnet 110 and the hub 106. FIG. 15A-15I are illustrations of embodiments of magnet roller adaptors 116, 118, 120, 122, 124, 126, 128, 132, and 194 for use in the universal magnet roller press assembly 101 of FIG. 4A and for use with the universal magnet roller press apparatus 100 of FIG. 1. FIG. 14A is an illustration of a front perspective view of embodiments of magnet roller adaptors 116, 118, 120, 122, 124, 126, 128, 132, and 194 for use in the universal magnet roller press assembly 101 of FIG. 4A and for use with the universal magnet roller press apparatus 100 of FIG. 1. FIG. 14A shows holder 278 for magnet roller adaptors 116, 118, 120, 122, 124, 126, 128, 132, and 194 comprising openings 279 sized to hold magnet roller adaptors 116, 118, 120, 122, 124, 126, 128, 132, and 194 in the holder 278. Magnet roll adaptor 128 comprises body portion 129 and collar portion 130. Magnet roll adaptor 132 comprises body portion 133 and collar portion 134. FIG. 14B is an illustration of a front view of the holder 278 for magnet roller adaptors 116, 118, 120, 122, 124, 126, 128, 132, and 194 of FIG. 14A.

Figure 5:
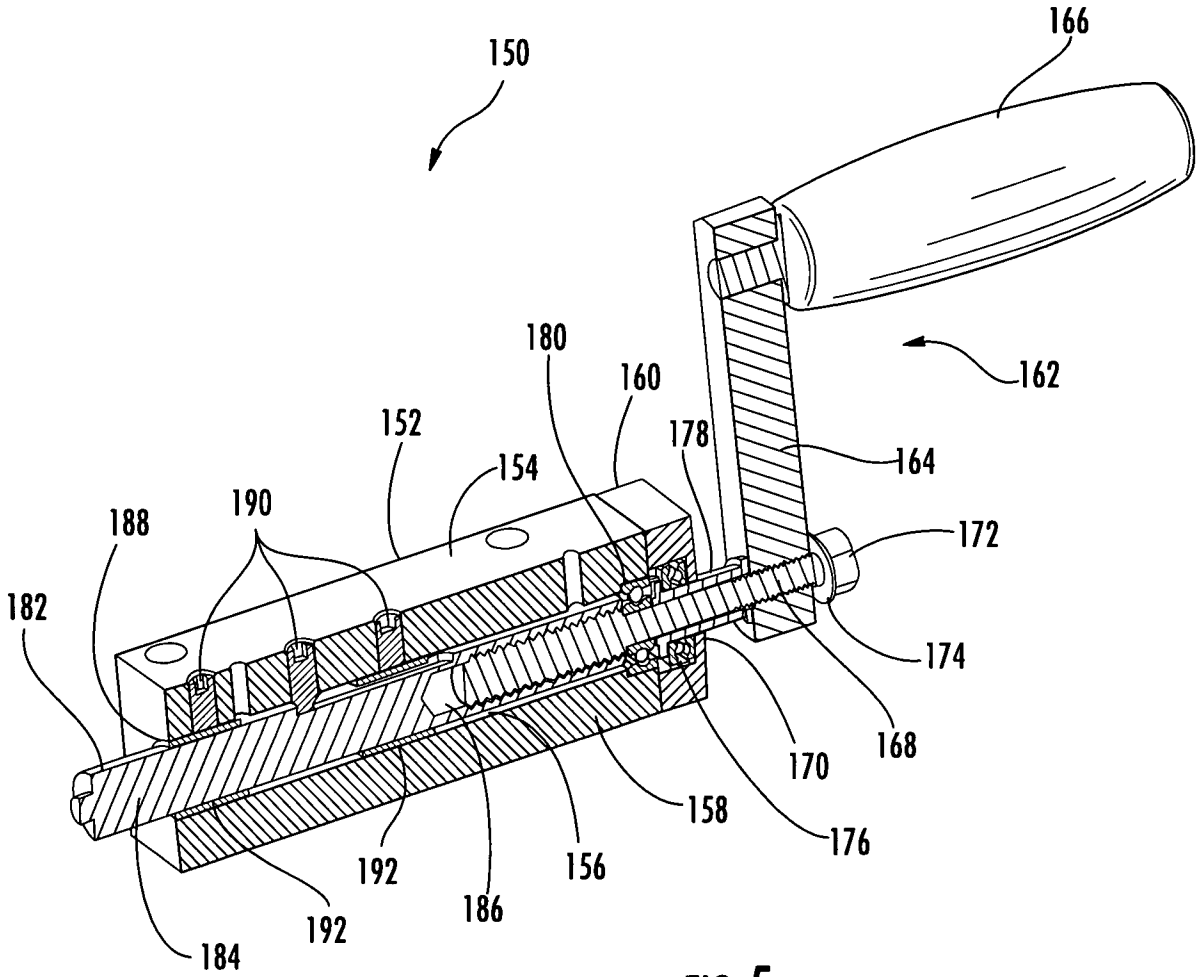
FIG. 5 is an illustration of a perspective view in partial cross-section of an embodiment of a screw drive assembly of the universal magnet roller press apparatus of the disclosure.
Figure 6:
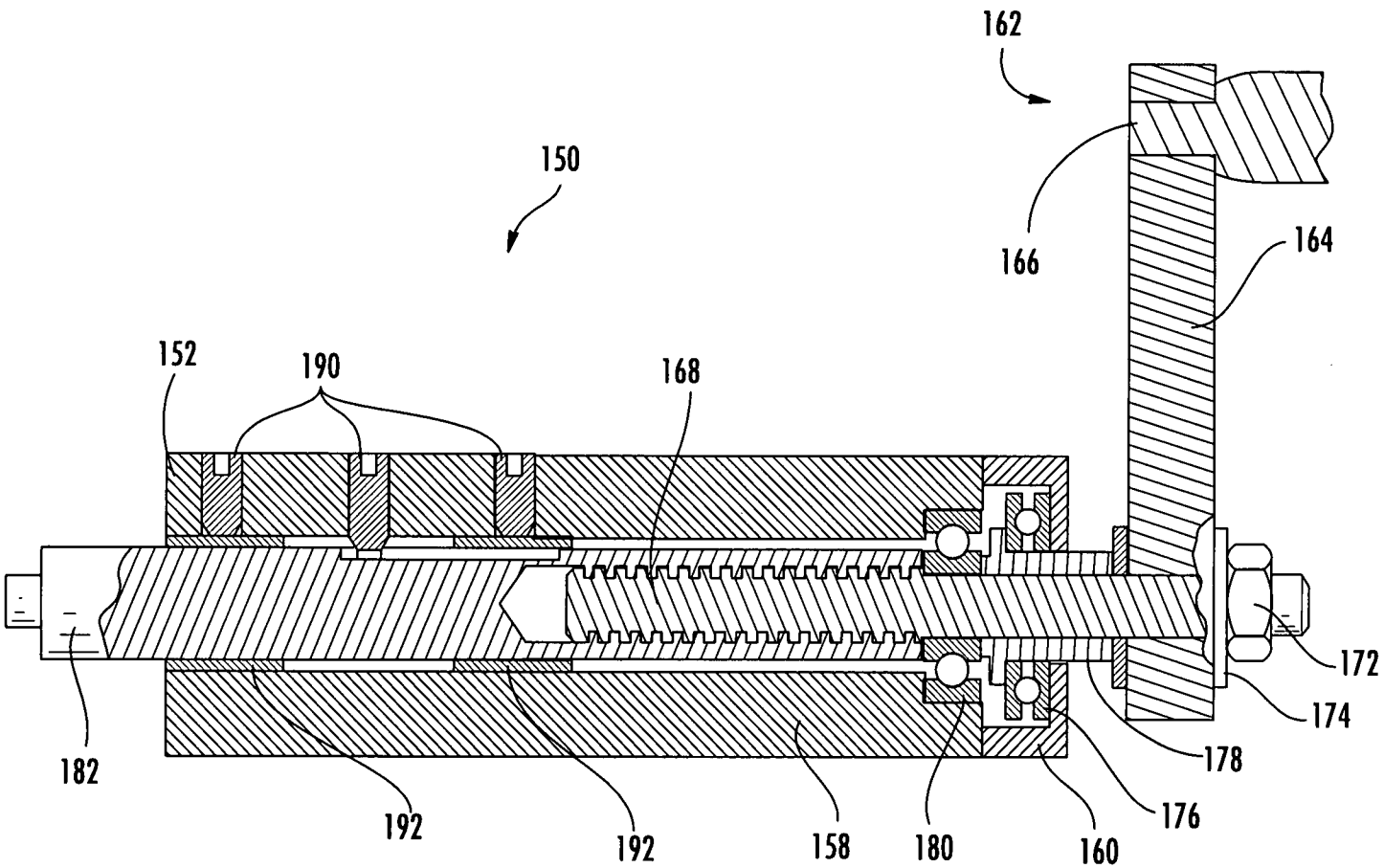
FIG. 6 is an illustration of a side view in partial cross section of an embodiment of a screw drive assembly of the universal magnet roller press apparatus of the disclosure.

FIG. 5 is an illustration of a perspective view in partial cross-section of an embodiment of a screw drive assembly 150 of the universal magnet roller press apparatus 100 (see FIG. 1) of the disclosure. FIG. 6 is an illustration of a side view in partial cross section of an embodiment of the screw drive assembly 150 of the universal magnet roller press apparatus 100 of the disclosure. As shown in FIG. 5, the screw drive assembly 150 comprises a block body 152 having a top portion 154, a central portion 156, a bottom portion 158, and a cap portion 160. The screw drive assembly 150 further comprises a revolving handle 162 attached to the block body 152. The revolving handle 162 has a handle attachment portion 164 and a revolving handle portion 166. The revolving handle 162 actuates the screw drive assembly 150. The screw drive assembly 150 further comprises an elongated screw 168 which is preferably threaded and located in the central portion 156 of the block body 152. The elongated screw 168 is preferably inserted through an opening 170 in the cap portion 160 of the block body 152. The elongated screw 168 is coupled at one end to the revolving handle 162 via a nut 172 and a washer 174 attachment. The elongated screw 168 may be inserted through opening 170 and through an axial bearing 176 having an axial bearing support 178. The axial bearing support 178 is also inserted thorough opening 170. The elongated screw 168 is further coupled to a radial bearing 180 surrounding a portion of the elongated screw 168. The screw drive assembly 150 further comprises a push rod 182 having a shaft 184 with a hollow portion 186. The push rod 182 is positioned within the block body 152. One or more set screws 190 and one or more bushings 192 may be used to position the push rod 182 in place within the block body 152. The elongated screw 168 may be actuated with the revolving handle 162 to move the elongated screw 168 through the hollow portion 186 to further engage and actuate the push rod 182 forward through an opening 188 in the block body 152 and out of the block body 152. The revolving handle 162 actuates the elongated screw 168 to engage the push rod 182 out of the block body 152, such that the push rod 182 pushes the magnet 110 and the hub 106 into and out of the magnet roller 102 during removal and installation of the magnet 110 and the hub 106.

As shown in FIG. 1, the adaptor 194 may be used over the push rod 182 as it extends through the opening 188 from the screw drive assembly 150. As shown in FIG. 1, the screw drive assembly 150 may further comprise the housing cover 196 to protect the screw drive assembly 150. The screw drive assembly 150 may preferably be attached to the top end portion 198 of the mounting base 136.

Figures 7A, 7B:
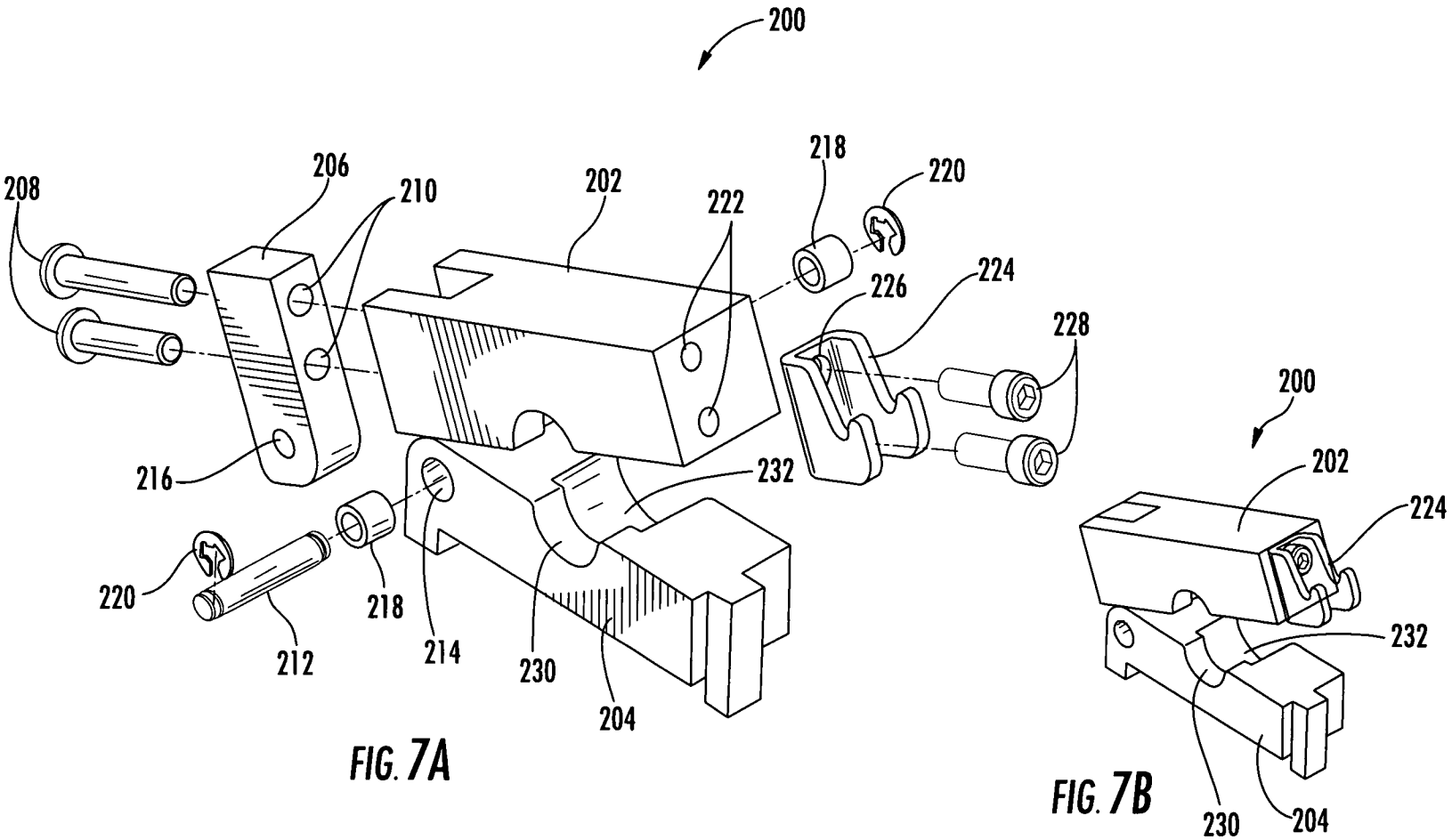
FIG. 7A is an illustration of an exploded view of an embodiment of a front support assembly of the universal magnet roller press apparatus of the disclosure.
FIG. 7B is an illustration of a perspective view of the assembled front support assembly of FIG. 7A.
Figure 16A:
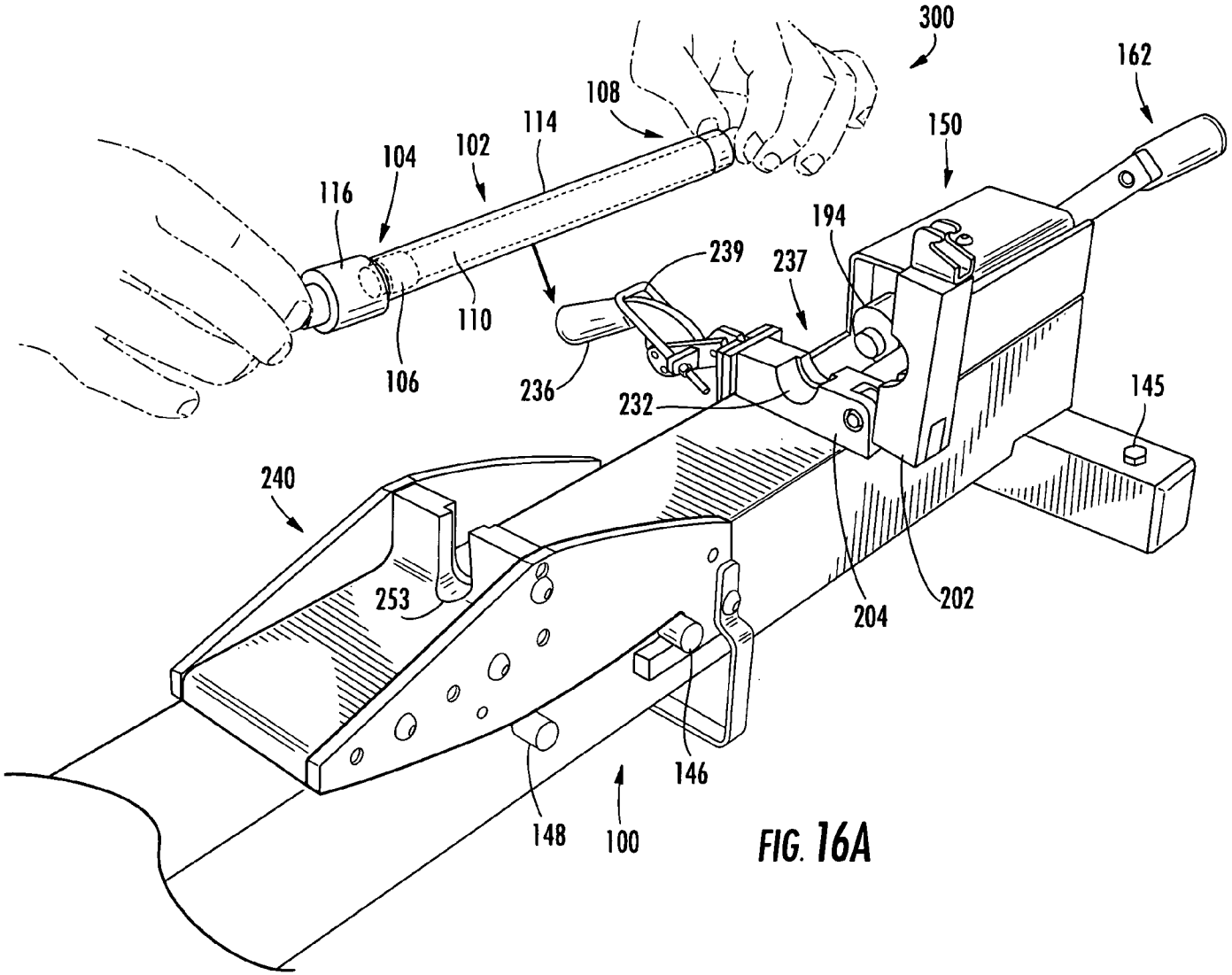
FIGS. 16A-16F are illustrations showing magnet and hub removal using embodiments of adaptors of the universal magnet roller press assembly of the disclosure.

FIG. 7A is an illustration of an exploded view of an embodiment of a front support assembly 200 of the universal magnet roller press apparatus 100 of the disclosure. FIG. 7B is an illustration of a perspective view of the assembled front support assembly 200 of FIG. 7A. Referring to FIG. 7A, the front support assembly 200 comprises a top part or magnet clamp bar 202, a bottom part or magnet clamp support 204, and a connector part 206 that connects the top part or magnet clamp bar 202 to the bottom part or magnet clamp support 204 via an attachment element 208, preferably in the form of one or more screws that may be inserted through one or more connector part holes 210. The connector part 206 may be attached to the magnet clamp support 204 with a connector element 212, such as a long grooved pin, inserted through a bottom part hole 214 and through a connector part opening 216. The connector element 212 may be used with one or more bushings 218 and one or more collar e-rings 220. The magnet clamp bar 202 may further comprise one or more holes 222 for attachment with a latch component 224. The latch component 224 may have one or more latch holes 226 that correspond to the holes 222. One or more screws 228 or other attachment means may be inserted through the latch holes 226 and the holes 222 to attach the latch component 224 to the top part or magnet clamp bar 202 of the front support assembly 200. When the front support assembly 200 is assembled, the top part or magnet clamp bar 202 and the bottom part or magnet clamp support 204 form a substantially circular opening 230 for insertion of the magnet roller 102. The magnet roller 102 may be supported by a support portion or cradle 232 on the magnet clamp support 204 of the front support assembly 200. As shown in FIG. 1, the front support assembly 200 is preferably located on a top portion 234 of the mounting base 136 downstream from the screw drive assembly 150 and downstream from the alignment cradle 144. As further shown in FIG. 1, the latch component 224 may be coupled to locking clamp handle 236 attached to the mounting base 136 with latch plate 238. When the magnet roller 102 is positioned in the front support assembly 200 for removal of the magnet and hub, latch component 224 can engage the locking clamp handle 236, and the locking clamp handle 236 can be moved upward into a locked position 235 (see FIG. 16D). When the removal is complete, the locking clamp handle 236 may be moved downward to unlatch from the latch component 224 into an unlocked position 237 (see FIG. 16A). The front support assembly 200 holds the magnet roller 102 in place during removal and installation of the magnet 110 and the hub 106.

Figure 8B:
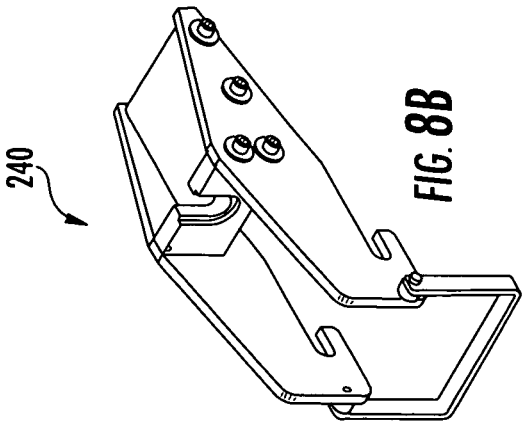
FIG. 8B is an illustration of a perspective view of the assembled back support assembly of FIG. 8A.
Figure 8A:
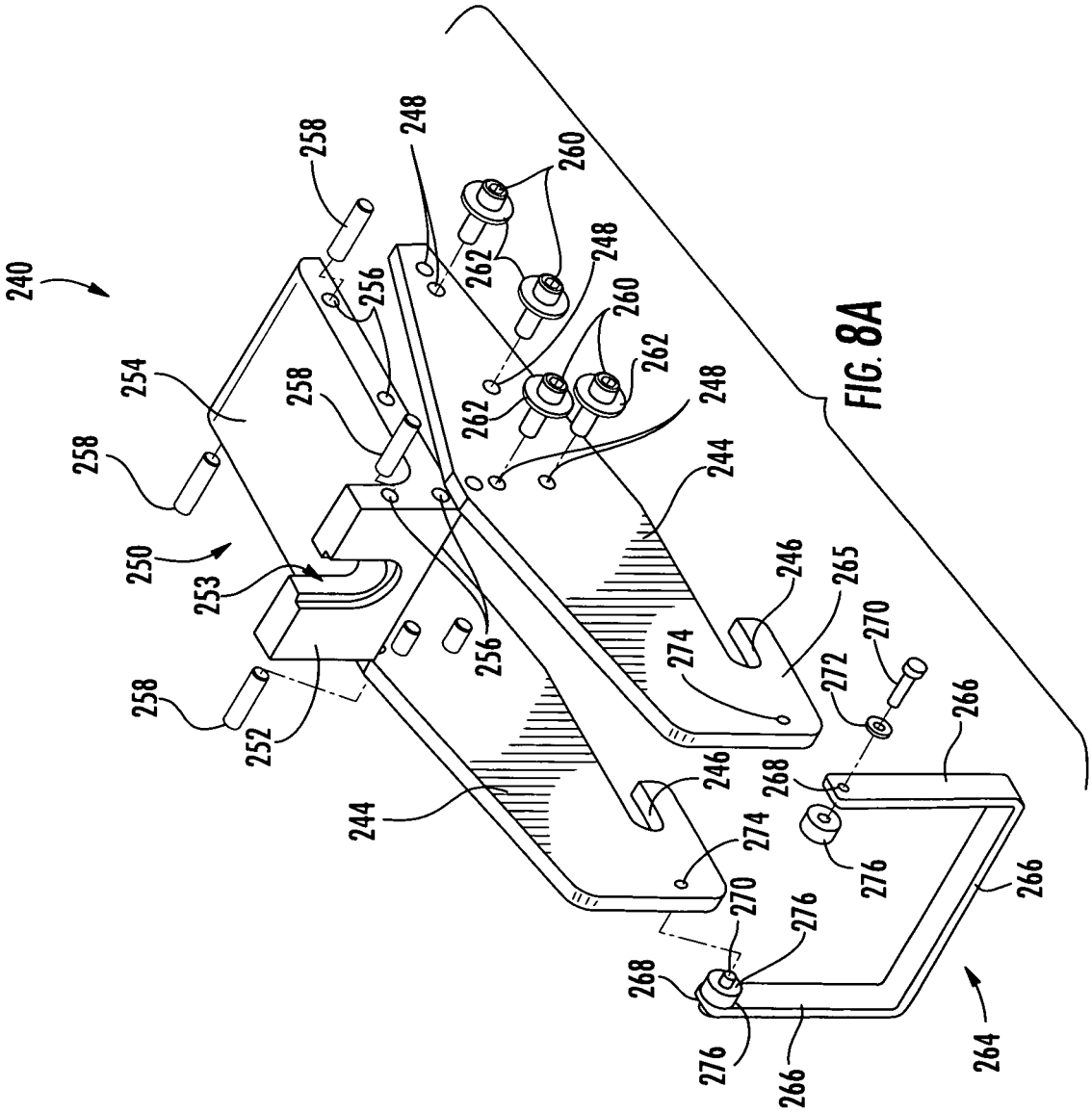
FIG. 8A is an illustration of an exploded view of an embodiment of a back support assembly of the universal magnet roller press apparatus of the disclosure.

FIG. 8A is an illustration of an exploded view of an embodiment of a back support assembly 240 of the universal magnet roller press apparatus 100 (see FIG. 1) of the disclosure. FIG. 8B is an illustration of a perspective view of the assembled back support assembly 240 of FIG. 8A. Referring to FIG. 8A, the back support assembly 240 comprises two preferably identical side plates 244 each having a hook end portion 246. The hook end portions 246 are designed to hook around the first rod stop 146 on each side of the mounting base 136 when magnet rollers of a shorter length are used with the apparatus 100. The hook end portions 246 are designed to hook around the second rod stop 148 on each side of the mounting base 136 when magnet rollers of a longer length are used with the apparatus 100. The side plates 244 may have one or more side plate holes 248. The back support assembly 240 further comprises a center block component 250 attached between the pair of side plates 244 and having a wall portion 252 with a substantially U-shaped back support slot 253 and having a platform portion 254. The center block component 250 may have one or more side holes 256. The center block component 250 may be attached on each side to the side plates 244 with suitable attachment means such as pins 258 and screws 260 with washers 262. The back support assembly 240 further comprises a slide retainer bracket 264 having sides 266 and coupled to the pair of side plates 244. The slide retainer bracket 264 may have one or more bracket holes 268 that may be used with attachment means, such as screws 270 and washers 272, to attach to corresponding holes 274 in the hook end portions 246 of the side plates 244. Bracket spacers 276 may be used to space the slide retainer bracket 264 from an outer portion 265 of the hook end portions 246. As shown in FIG. 1, the back support assembly 240 is preferably located on top portion 242 of the mounting base 136 downstream from the screw drive assembly 150, downstream from the alignment cradle 144, and downstream from the front support assembly 200. The back support assembly 240 holds one end of the magnet roller 102 in place during removal and installation of the magnet 110 and the hub 106.

Figure 9A:
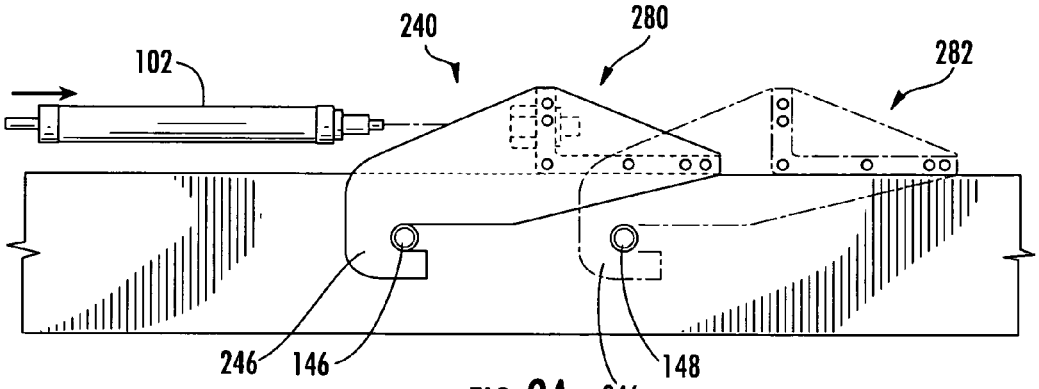
FIG. 9A is an illustration of a side view of an embodiment of a back support assembly of the universal magnet roller press apparatus of the disclosure showing a first position and a second position.

FIG. 9A is an illustration of a side view of an embodiment of the back support assembly 240 of the universal magnet roller press apparatus 100 (see FIG. 1) of the disclosure. FIG. 9A shows the back support assembly 240 coupled to the first rod stop 146 in a first position 280 and in broken lines shows the back support assembly 240 coupled to the second rod stop 148 in a second position 282 for use with the magnet roller 102. In the first position 280, the hook end portion 246 of the back support assembly 240 is engaged with the first rod stop 146 for shorter magnet rollers. In the second position 282, the hook end portion 246 of the back support assembly 240 is moved back and is engaged with the second rod stop 148 for longer magnet rollers.

Figure 9B:
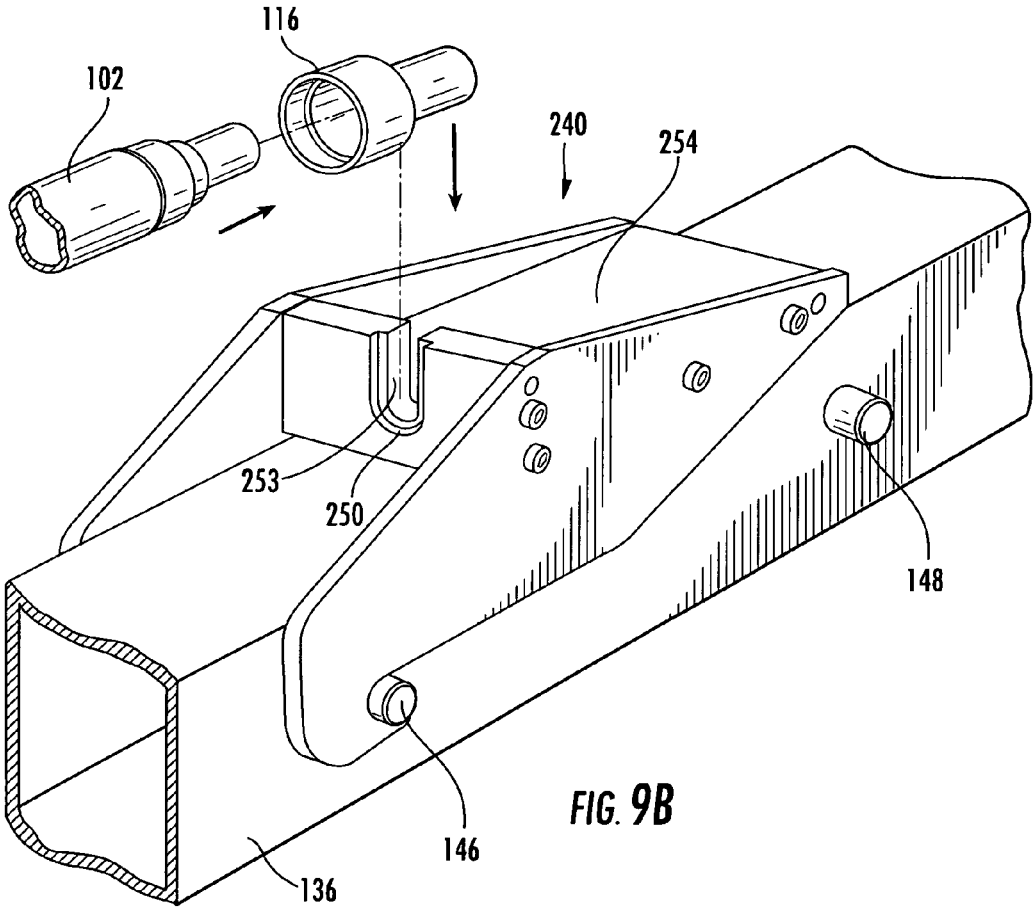
FIG. 9B is an illustration of a front right side perspective view of an embodiment of a back support assembly of the universal magnet roller press apparatus of the disclosure.

FIG. 9B is an illustration of a front right side perspective view of an embodiment of the back support assembly 240 of the universal magnet roller press apparatus 100 (see FIG. 1) of the disclosure. FIG. 9B shows the back support assembly 240 coupled to the first rod stop 146 of the mounting base 136, shows the magnet roller 102 in position for insertion into adaptor 116, and shows the adaptor 116 in position to be inserted into the U-shaped back support slot 253 of the center block component 250 of the back support assembly 240.

Figure 10:
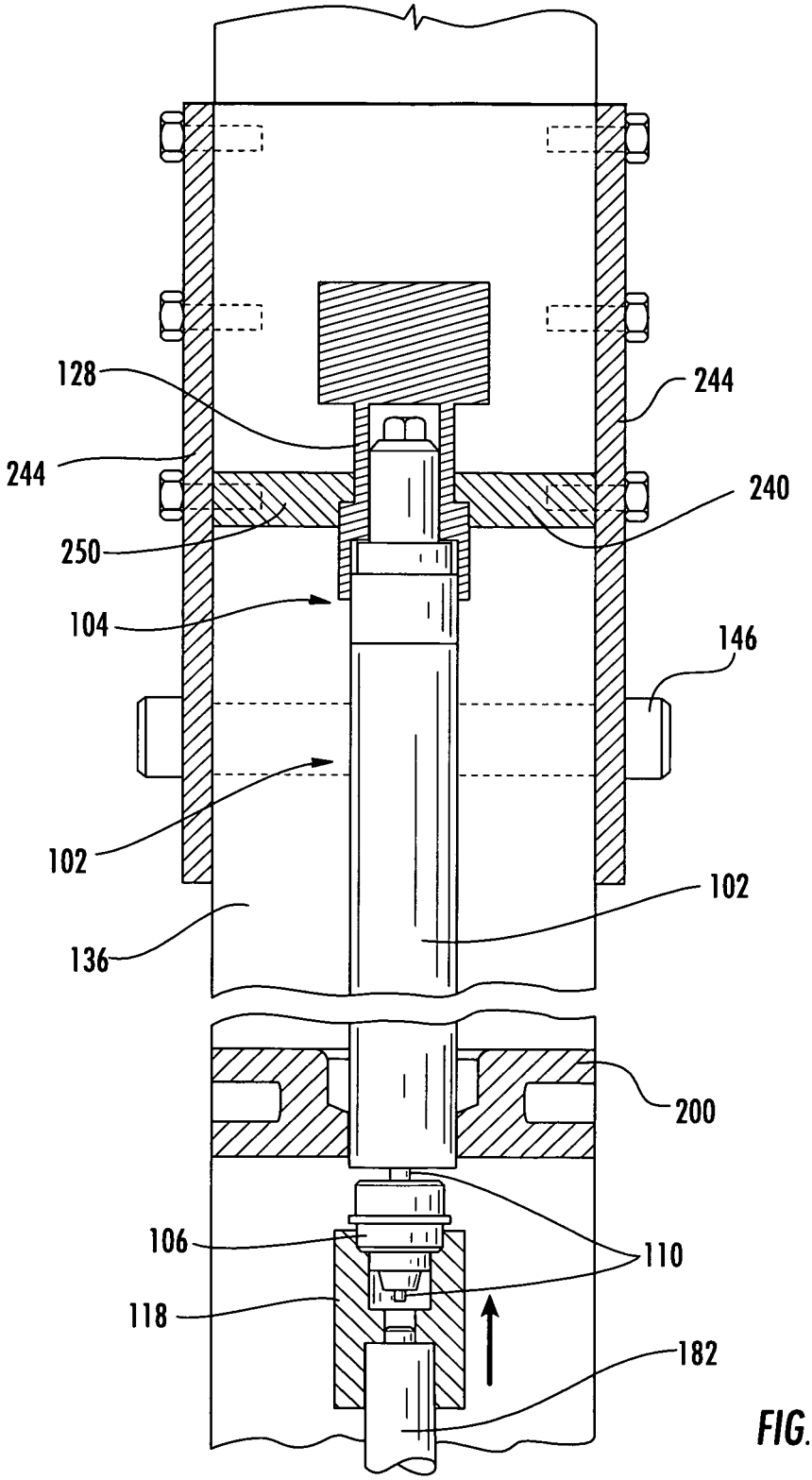
FIG. 10 is a top view of a magnet roller positioned for installation in one of the embodiments of the universal magnet roller press apparatus of the disclosure.

FIG. 10 is a top view of magnet roller 102 positioned for installation in one of the embodiments of the universal magnet roller press apparatus 100 of the disclosure. FIG. 10 shows the hub 106 of the magnet roller 102 coupled to adaptor 118 and engaged with push rod 182 and the magnet roller 102 end positioned in front support assembly 200. FIG. 10 further shows the opposite end of the magnet roller 102 coupled to adaptor 128 and positioned in center block component 250 of back support assembly 240.

Figure 11A:
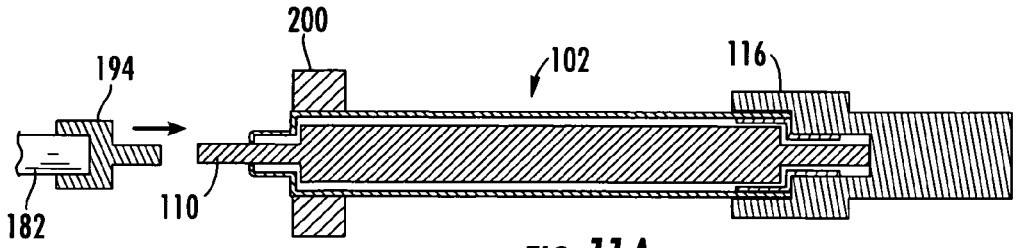
FIGS. 11A-11B are illustrations of top cross-sectional views showing magnet and hub removal using embodiments of adaptors of the universal magnet roller press assembly of the disclosure.
Figure 11B:
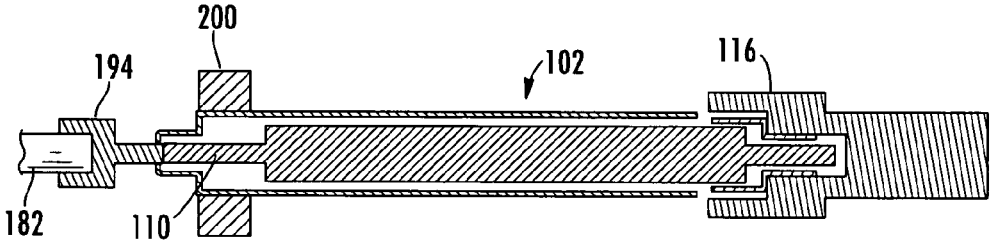
Figure 12A:
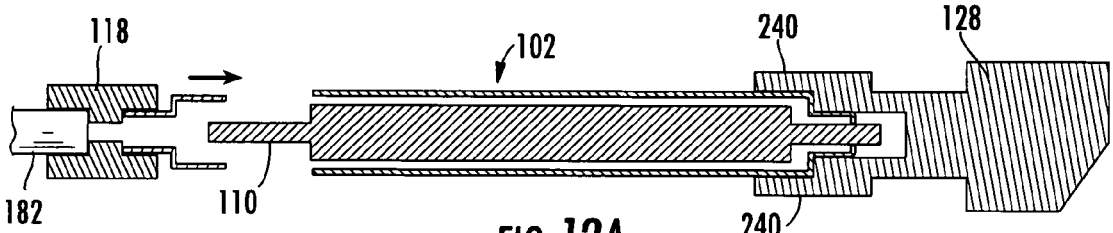
FIGS. 12A-12B are illustrations of top cross-sectional views showing magnet and hub installation using other embodiments of adaptors of the universal magnet roller press assembly of the disclosure.
Figure 12B:
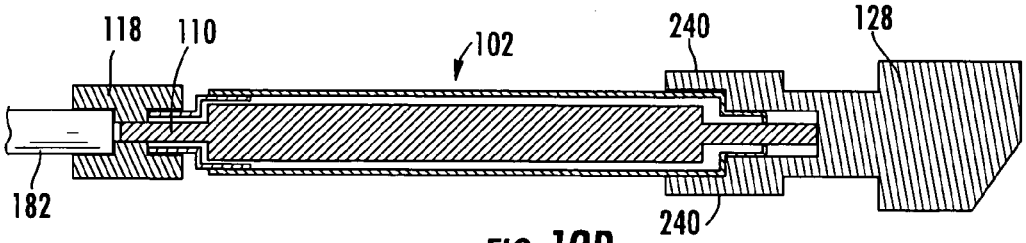
Figure 13A:
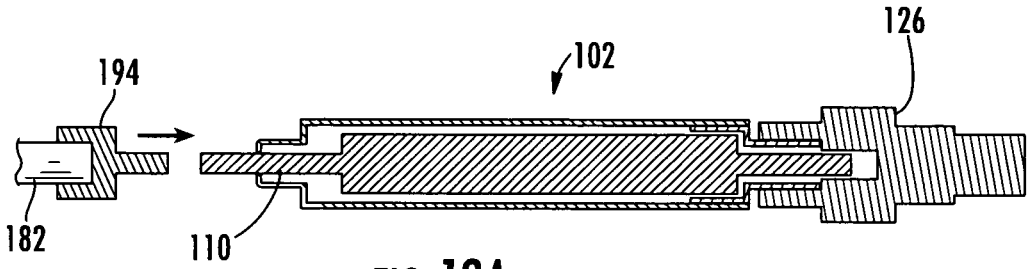
FIGS. 13A-13B are illustrations of top cross-sectional views showing magnet and hub removal using other embodiments of adaptors of the universal magnet roller press assembly of the disclosure.
Figure 13B:
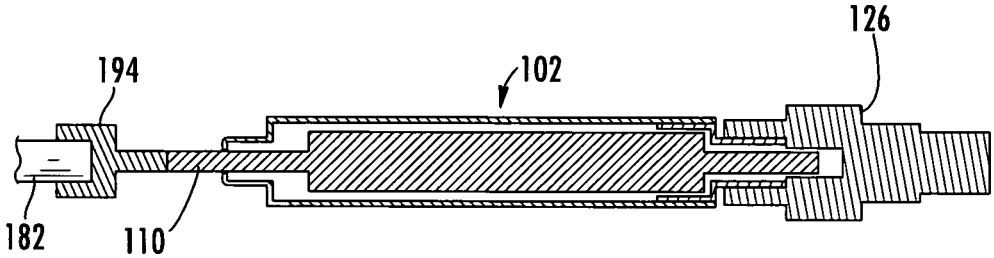

FIGS. 11A-11B are illustrations of top cross-sectional views showing magnet and hub removal using embodiments of adaptors 194 and 116 of the universal magnet roller press assembly 101 of the disclosure. FIGS. 12A-12B are illustrations of top cross-sectional views showing magnet and hub installation using embodiments of adaptors 118, 128 of the universal magnet roller press assembly 101 of the disclosure. FIGS. 13A-13B are illustrations of top cross-sectional views showing magnet and hub removal using embodiments of adaptors 194, 126 of the universal magnet roller press assembly 101 of the disclosure.

Figure 23:
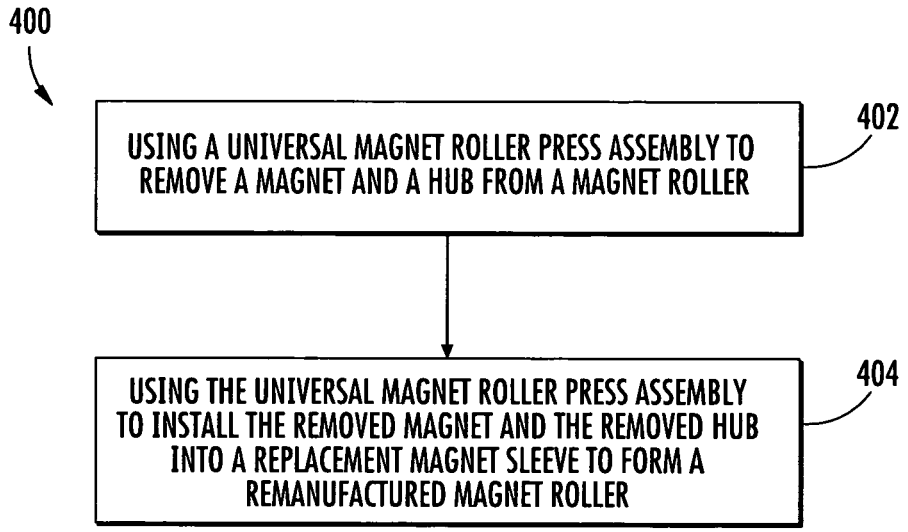
FIG. 23 is an illustration of a flow diagram showing steps of an embodiment of a method for remanufacturing a magnet roller using one of the embodiments of the universal magnet roller press apparatus and assembly of the disclosure; and, FIG. 24 is an illustration of a flow diagram showing steps of another embodiment of a method for remanufacturing a magnet roller using one of the embodiments of the universal magnet roller press apparatus and assembly of the disclosure.
Figure 24:
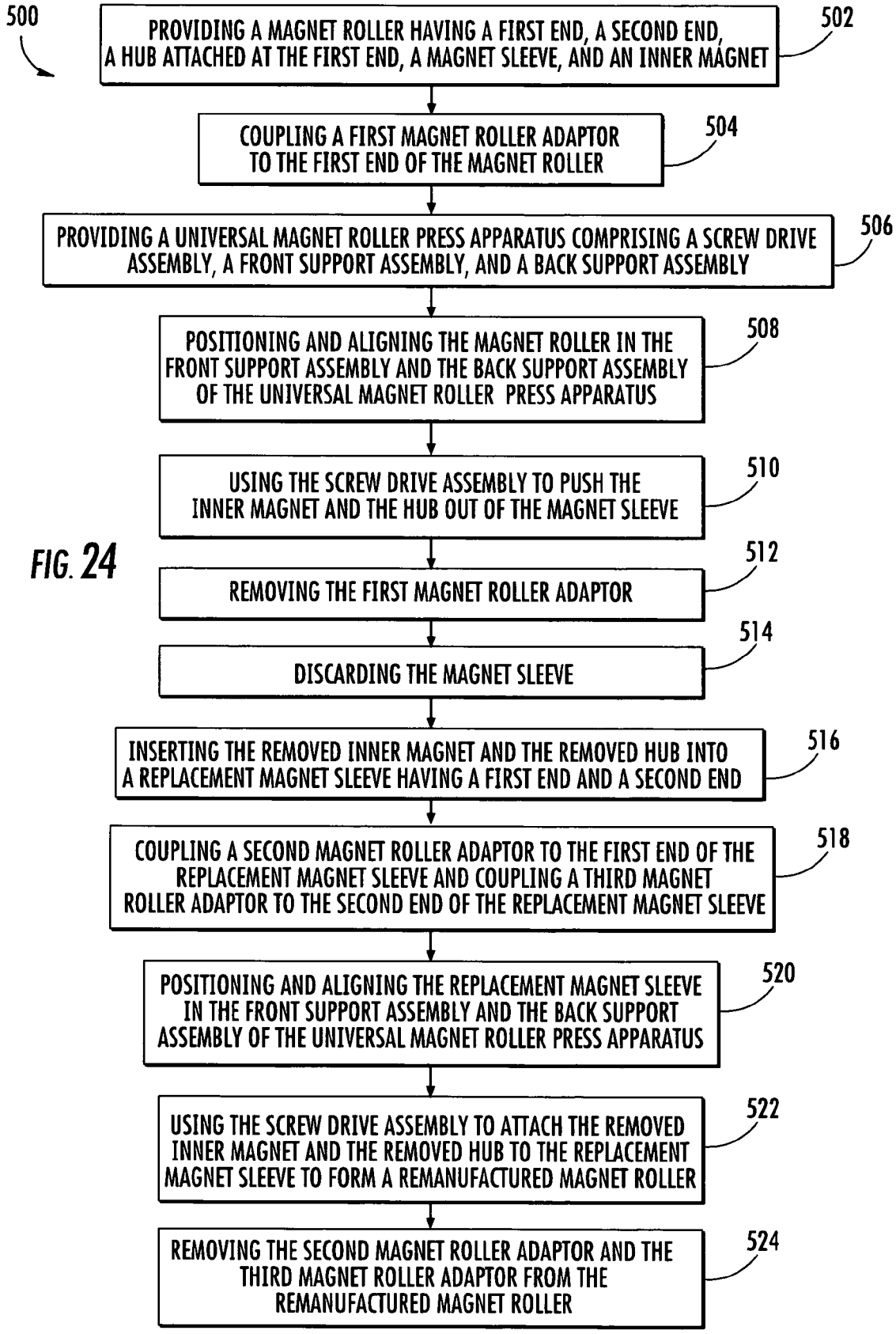

In another embodiment there is provided a method 400 for removing and installing a magnet 110 (see FIG. 2) and a hub 106 of a magnet roller 102 of a toner printer cartridge (not shown). FIG. 23 is an illustration of a flow diagram showing an embodiment of the method 400. The method 400 comprises step 402 of using a universal magnet roller press assembly 101 (see FIGS. 4A-4B) or 11 (see FIG. 17A, 19A-19F) to remove a magnet 110 (see FIG. 2) or 18 (see FIG. 18A) and a hub 106 (see FIG. 2) or 17 (see FIG. 18A) from a magnet roller 102 (see FIG. 2) or 12 (see FIG. 18A). The method 400 further comprises step 404 of using the universal magnet roller assembly 101 or 11 to install the removed magnet and the removed hub into a replacement magnet sleeve 302 (see FIG. 16G) to form a remanufactured magnet roller 308 (see FIG. 16G).

In another embodiment there is provided a method 500 for remanufacturing a magnet roller 102 of a toner printer cartridge. FIG. 23 is an illustration of a flow diagram showing an embodiment of the method 500. FIGS. 16A-16F are illustrations showing magnet and hub removal by a user 300 using one or more embodiments of magnet roller adaptors 116, 118, 120, 122, 124, 126, 128, 132, and 194 of the universal magnet roller press assembly 101 of the disclosure. FIGS. 16G-16K are illustrations showing magnet and hub installation using one or more embodiments of adaptors 116, 118, 120, 122, 124, 126, 128, 132, and 194 of the universal magnet roller press assembly 101 of the disclosure.

The method 500 comprises step 502 of providing a magnet roller 102 (see FIG. 16A) having a first end 104, a second end 108, a hub 106 attached at the first end 104, a magnet sleeve 114, and a magnet 110 preferably an inner magnet. The first part of the method involves removal of the magnet 110 and the hub 106 from a magnet roller 102 such as a worn magnet roller with a worn magnet sleeve 114. The method 500 further comprises step 504 of coupling a first magnet roller adaptor 116 (see FIG. 16A) to the first end 104 or non-drive end of the magnet roller 102. The method 500 further comprises step 506 of providing a universal magnet roller press apparatus 100 (see FIG. 16A) comprising a screw drive assembly 150 having a revolving handle 162 and a push rod 182 (see FIG. 5), a front support assembly 200, and a back support assembly 240. In operation, preferably, the apparatus 100 is attached to a substantially flat surface with one or more bolts 145 (see FIG. 16A). However, screws or clamps may also be used to secure the apparatus 100 to a flat surface. The mag clamp bar 202 of the front support assembly 200 is opened to an open position 237 (see FIG. 16A). A magnet roller adaptor 194 may preferably be attached to push rod 182 (see FIG. 5).

Figure 16B:
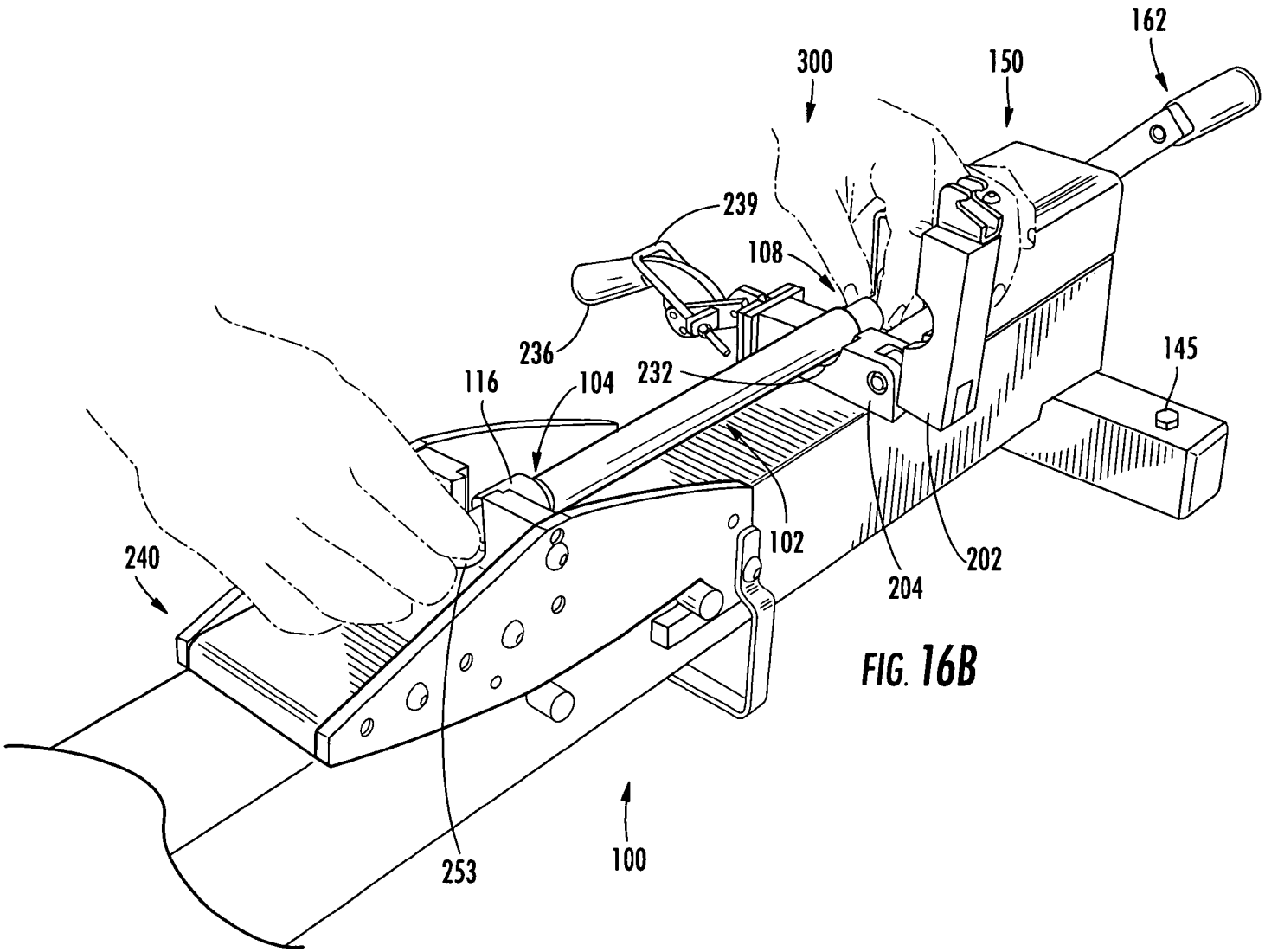
Figure 16C:
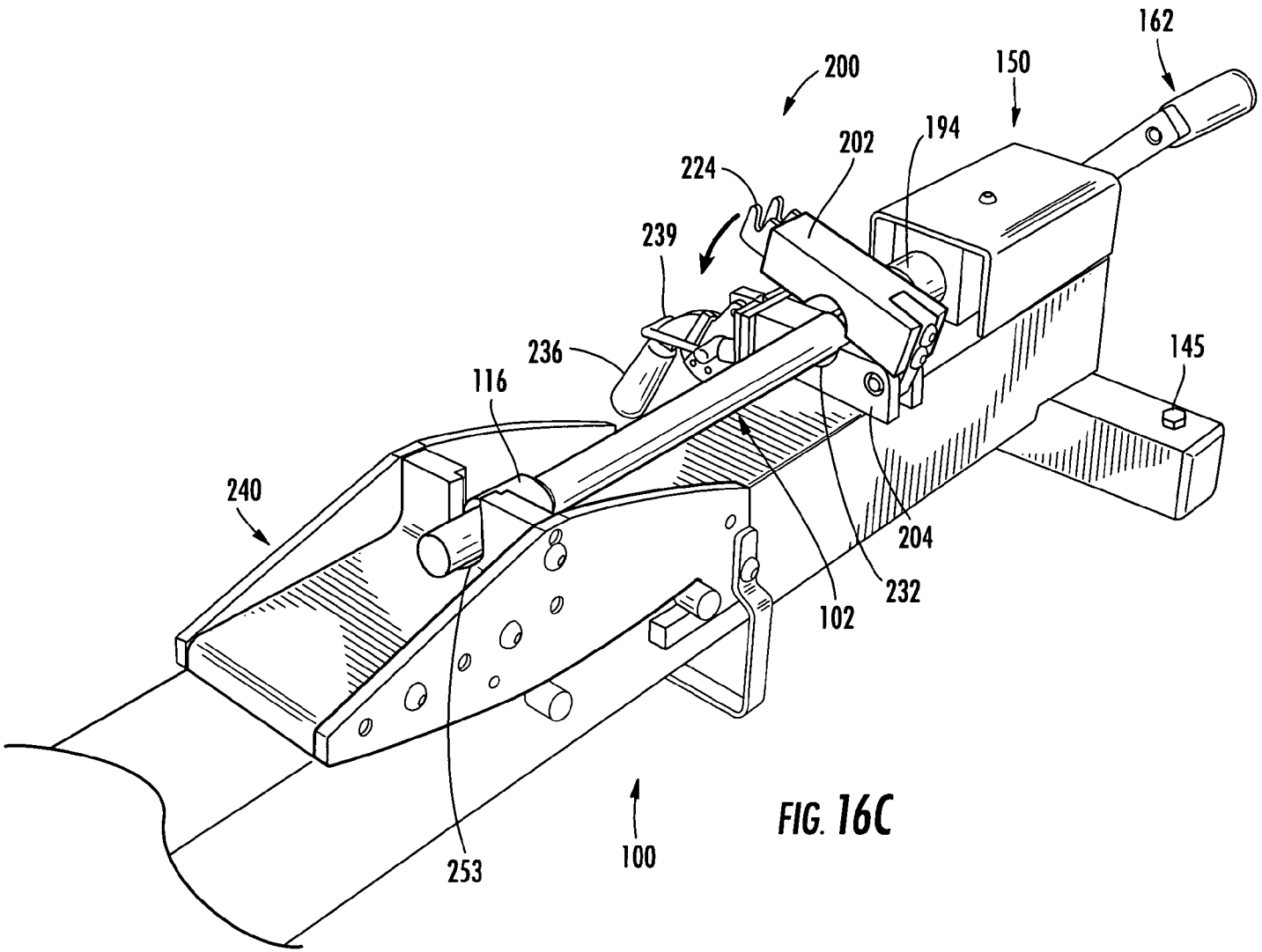
Figure 16D:
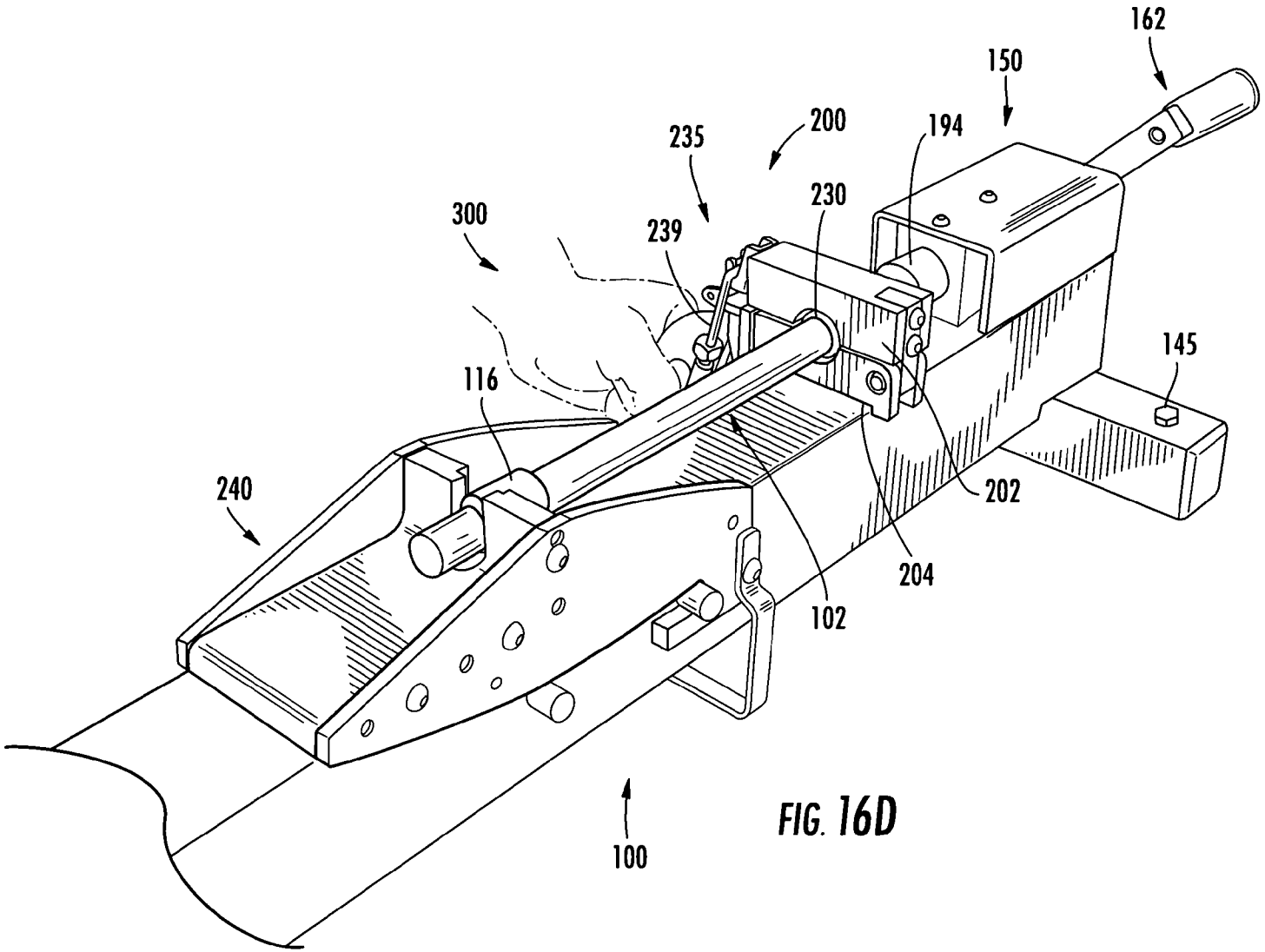
Figure 16E:
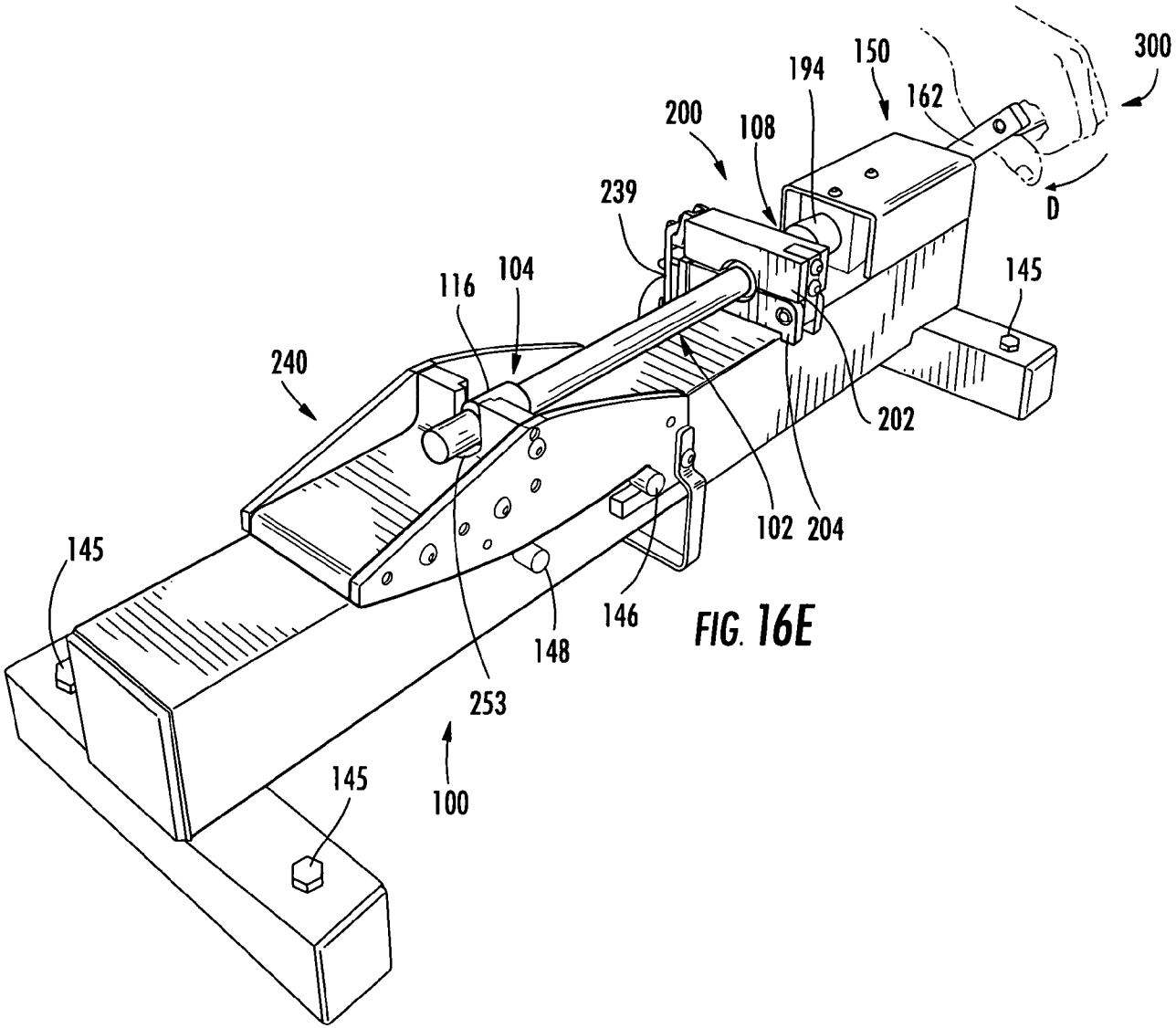
Figure 16F:
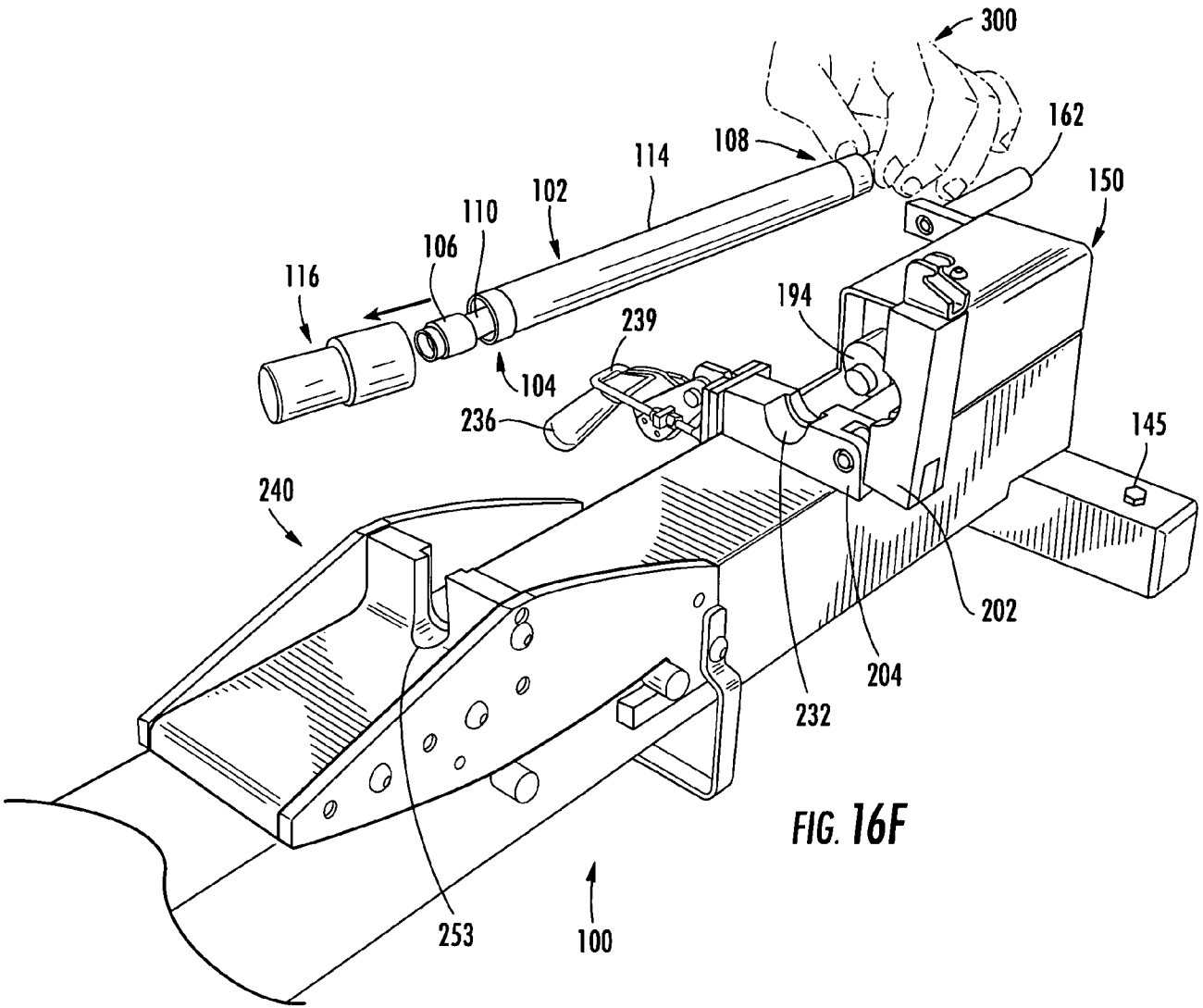

The method 500 further comprises step 508, as shown in FIG. 16B, of positioning and aligning the second end 108 or drive end of the magnet roller 102 in the support portion or cradle 232 on the magnet clamp support 204 of the front support assembly 200 and positioning and aligning the first end 104 or non-drive end with the first magnet roller adaptor 116 in the U-shaped support portion 253 of the back support assembly 240 of the universal magnet roller press apparatus 100. As shown in FIG. 16C, the mag clamp bar 202 is closed over the second end 108 of the magnet roller 102. As shown in FIG. 16D, the U-hook 239 of the locking clamp handle 236 is attached to the latch component 224 and the locking clamp handle 236 is pushed down to lock the front support assembly 200 over the second end 108 of the magnet roller 102 in a locked position 235. The method 500 further comprises step 510 of using the screw drive assembly 150 to push the inner magnet 110 and the hub 106 out of the magnet sleeve 114. As shown in FIG. 16E, the revolving handle 162 is preferably rotated counter-clockwise in direction (D) to push the magnet 110 through the magnet sleeve 114 until the hub 106 moves or slides out at the first end 104 (see FIG. 16F). After the magnet 110 and hub 106 are pushed out of the first end 104 of the magnet roller 102, the locking clamp handle 235 is pulled up and the mag clamp bar 202 is opened to remove the magnet roller 102. The method 500 further comprises step 512 of removing the first magnet roller adaptor 116. Preferably, the revolving handle 162 is rotated counter-clockwise to a beginning position. The method 500 further comprises step 514 of discarding the magnet sleeve 114. Alternatively, the magnet sleeve 114 may be recycled.

Figure 16G:
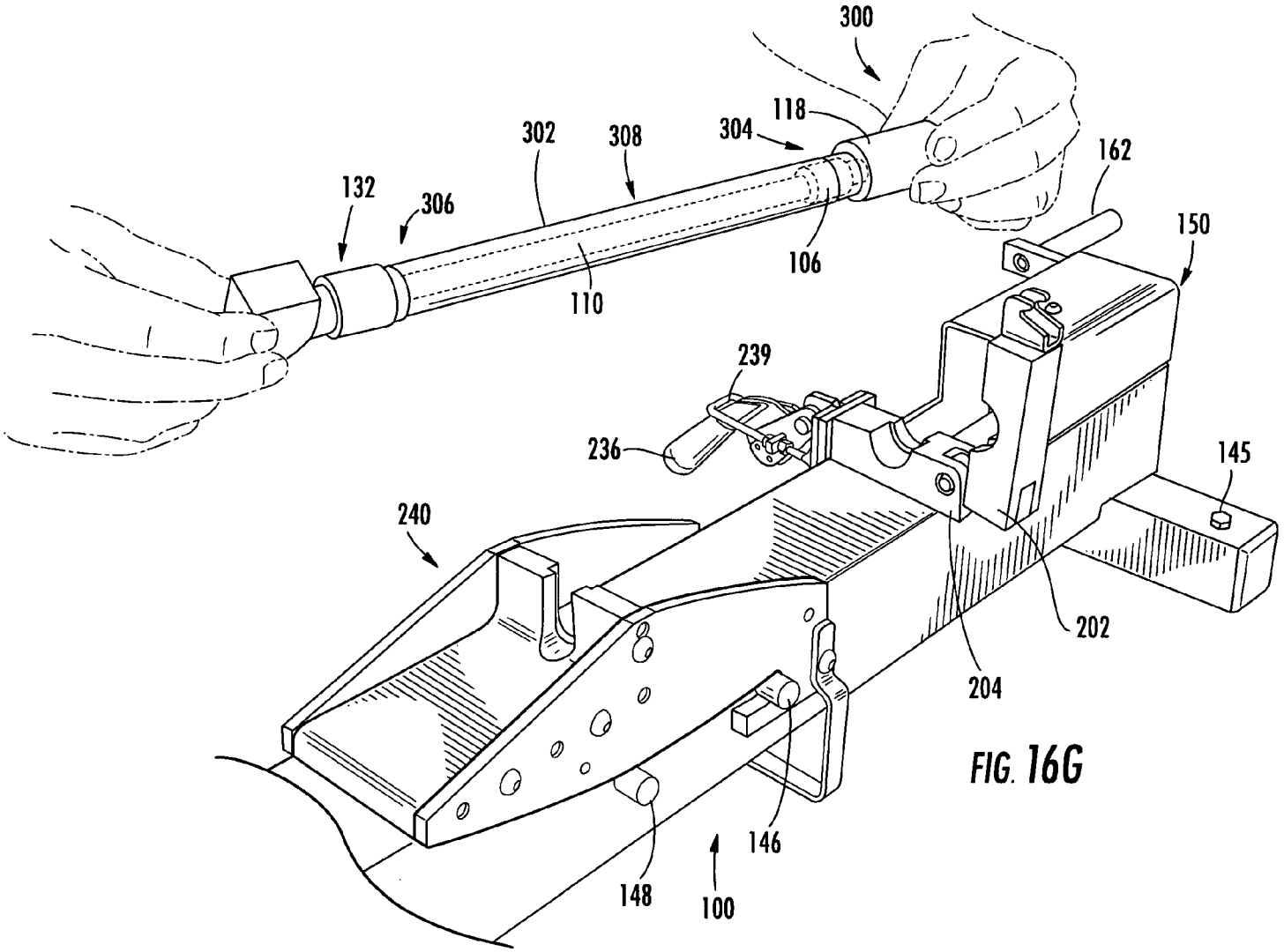
FIGS. 16G-16K are illustrations showing magnet and hub installation using embodiments of adaptors of the universal magnet roller press assembly of the disclosure.
Figure 16H:
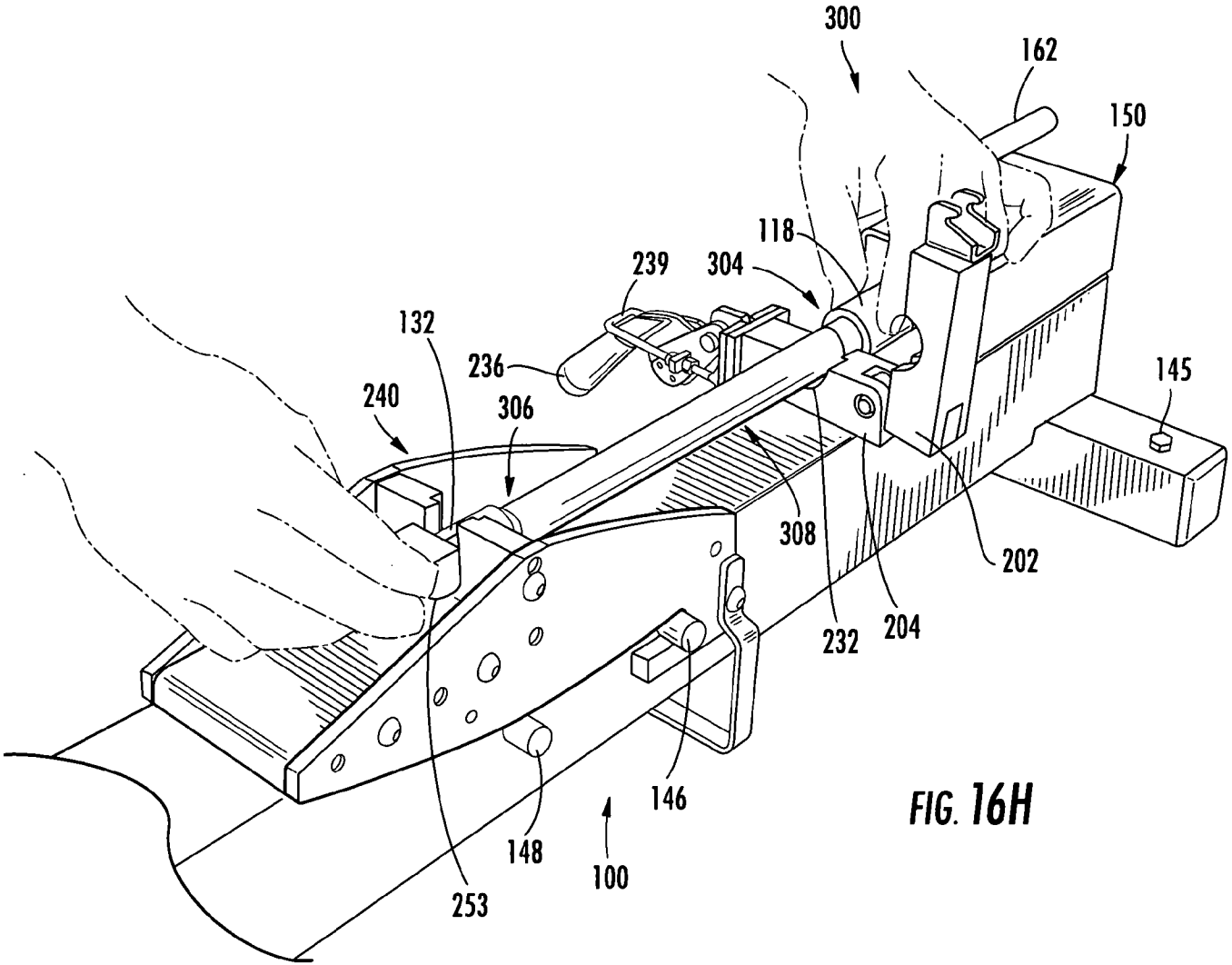
Figure 16I:
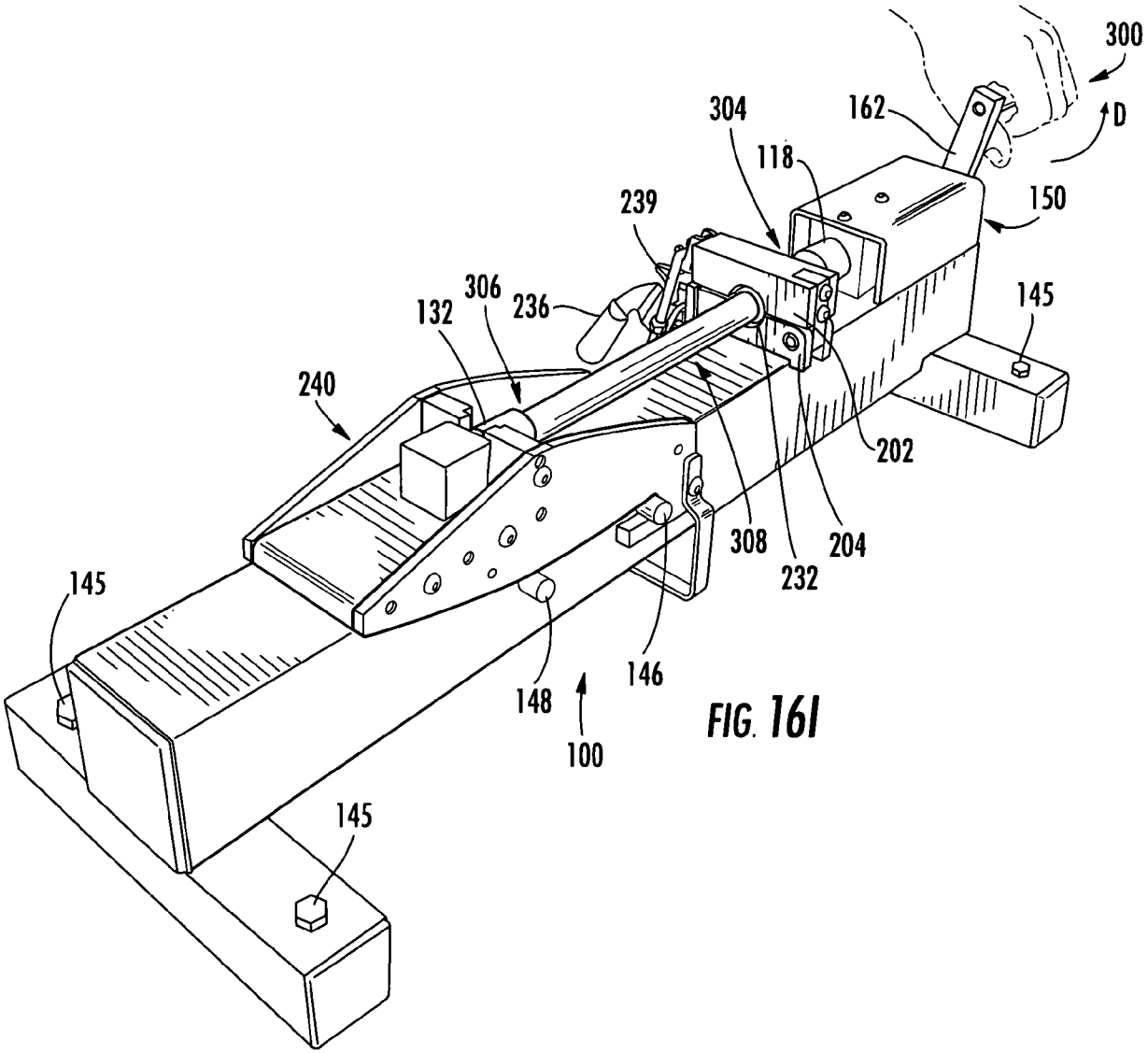
Figure 16J:
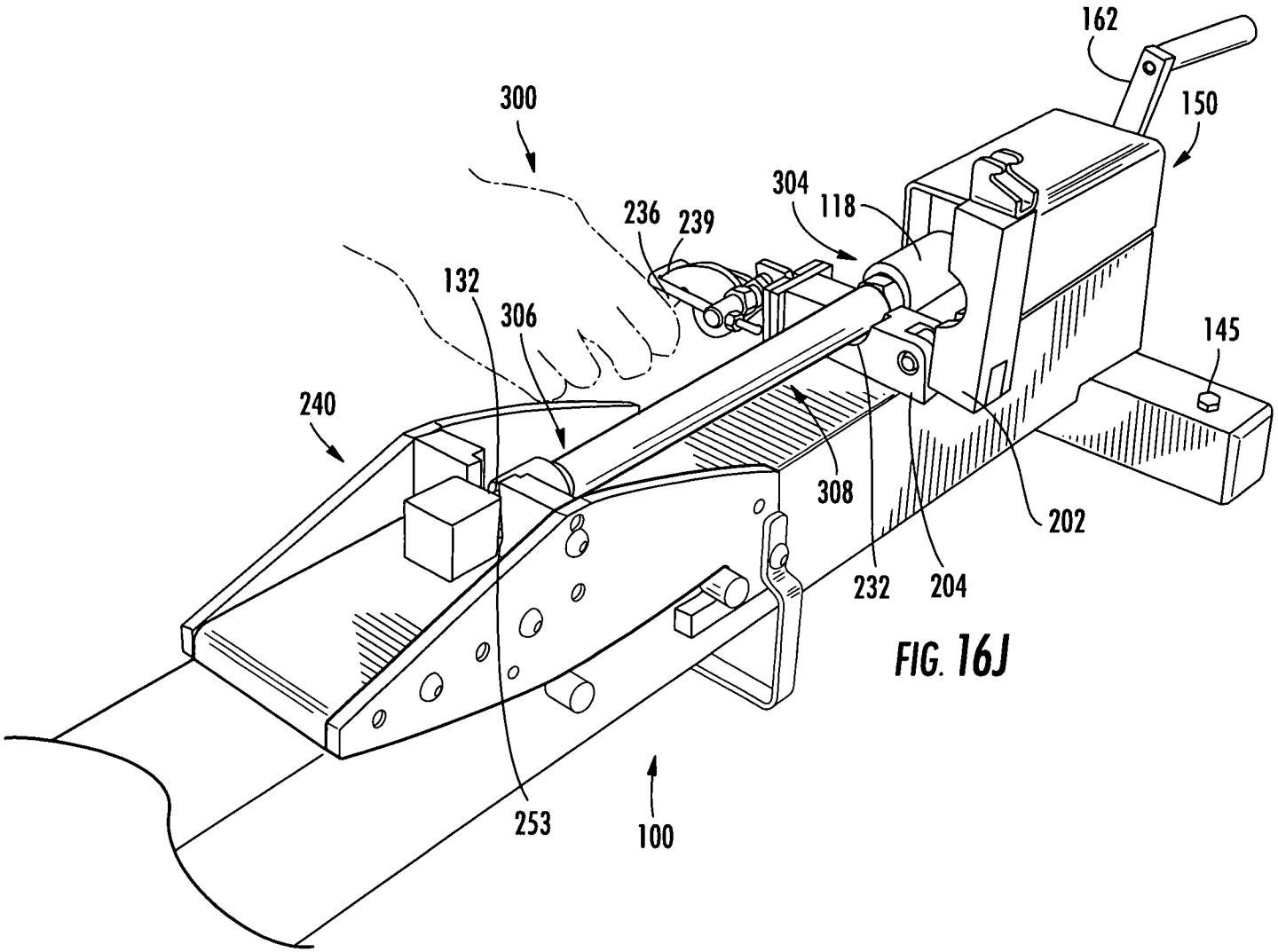
Figure 16K:
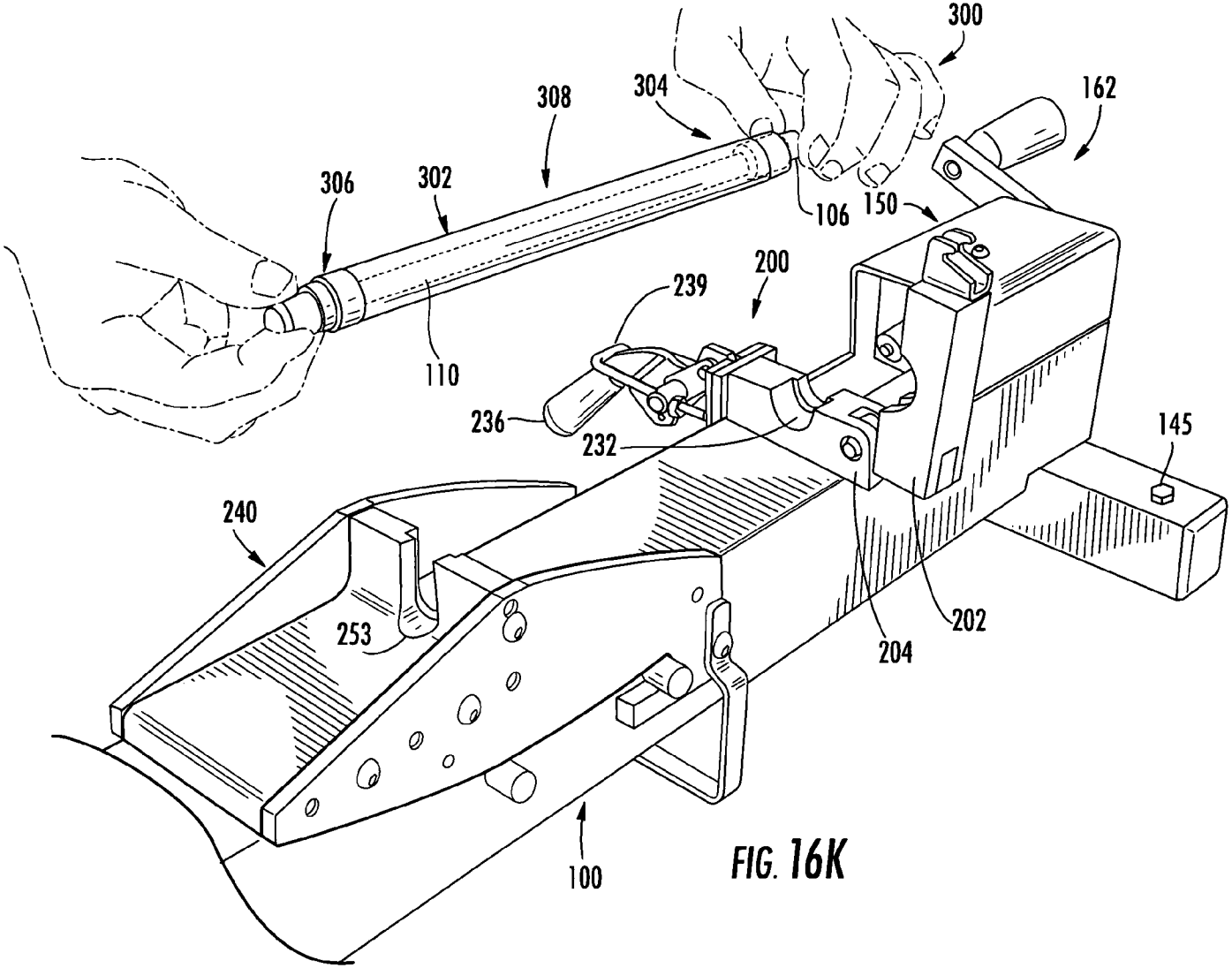

The method 500 then comprises the installation steps for installing the removed magnet 110 and the removed hub 106 into a replacement magnet sleeve 302 (see FIG. 16G). The back support assembly 240 may be positioned at the first rod stop 146 or the second rod stop 148. The replacement magnet sleeve 302 comprises a first end 304 and a second end 306. The method 500 further comprises step 516 of inserting the removed inner magnet 110 and the removed hub 106 into the replacement magnet sleeve 302 having the first end 304 and the second end 306. As shown in FIG. 16G, the method 500 further comprises step 518 of coupling a second magnet roller adaptor 118 to the first end 304 of the replacement magnet sleeve 302 and coupling a third magnet roller adaptor 132 to the second end 306 of the replacement magnet sleeve 302. As shown in FIG. 16H, the method 500 further comprises step 520 of positioning and aligning the replacement magnet sleeve 302 in the front support assembly 200 and the back support assembly 240 of the universal magnet roller press apparatus 100. As shown in FIG. 16I, the mag clamp bar 202 is closed over the second end 108 of the magnet roller 102 but the locking clamp handle 236 does not need to be locked over the first end 304 of the remanufactured magnet roller 308. The front support assembly 200 may be closed but the locking clamp handle 236 is preferably not used with installation to prevent damage to the magnet roller 308. The method 500 further comprises step 522 of using the screw drive assembly 150 to attach the removed inner magnet 110 and the removed hub 106 to the replacement magnet sleeve 302 to form a remanufactured magnet roller 308. As shown in FIG. 16I, the revolving handle 162 is rotated in a clockwise direction (D) to press the removed hub 106 into the replacement magnet sleeve 302 until the rim of the hub 106 is pressed against the replacement magnet sleeve 302 all the way around the edge. To remove the remanufactured magnet roller 308, rotate the revolving handle 162 clockwise to the beginning position, open the mag clamp bar 202 and remove the remanufactured magnet roller 308. The method 500 further comprises step 524 of removing the second magnet roller adaptor 118 and the third magnet roller adaptor 132 from the remanufactured magnet roller 308.

When the magnet roller 102 is used with the apparatus 100 and it is desired to remove the inner magnet 110 and hub 106, a magnet roller adaptor 116 (see FIG. 4A) may be coupled to the first end 104 of the magnet roller 102 before positioning the magnet roller 102 in the apparatus 100. When the magnet roller 102 is used with the apparatus 100 and it is desired to install the inner magnet 110 and hub 106 into a second or replacement magnet sleeve 302, preferably one of magnet roller adaptors 118, 120, or 122 (see FIG. 14A) may be coupled to the first end 104 of the magnet roller 102 before positioning the magnet roller 102 in the apparatus 100. The magnet roller adaptors 118, 120, 122 may be used with extra long magnet rollers (e.g., about 13.16 inches), long magnet rollers (e.g., about 13.10 inches), or short magnet rollers (e.g., about 9.42 inches), depending on what is desired. When the magnet roller 102 is used with the apparatus 100 and it is desired to install the inner magnet 110 and hub 106 into a second or replacement magnet sleeve 302, one or more of a magnet roller adaptors 124, 126, 128, and 132 may be coupled to the second end 108 of the magnet roller 102 before positioning the magnet roller 102 in the apparatus 100.

In another embodiment there is provided a method for removing and installing a magnet and a hub of a magnet roller of a toner printer cartridge used in electrophotographic image forming devices. The method comprises removing a magnet and a hub from a magnet roller by positioning and aligning the magnet roller in a universal magnet roller press apparatus, actuating with a revolving handle a push rod of a screw drive assembly to push the magnet and the hub out of a magnet sleeve, and discarding the magnet sleeve. The method further comprises installing the removed magnet and the removed hub into a replacement magnet sleeve by inserting the removed magnet and the removed hub into the replacement magnet sleeve, positioning and aligning the removed magnet and the removed hub within the replacement magnet sleeve in the universal magnet roller press apparatus, and actuating with the revolving handle the push rod of the screw drive assembly to push the removed magnet and the removed hub into the replacement magnet sleeve so that the removed magnet and the removed hub attach to the replacement magnet sleeve. The method further comprises removing the attached magnet roller from the apparatus.

All of the methods disclosed herein allow for securement of the magnet roller in the apparatus during removal and installation of the magnet and hub to avoid damage to the magnet and hub. In addition, all of the methods disclosed herein allow for proper alignment of the magnet roller during removal and installation of the magnet and hub.

In another embodiment there is provided a universal magnet roller press assembly 11 for removing and installing a magnet 18 and a hub 17 of a magnet roller 12 of a toner printer cartridge. As shown in FIGS. 17A-17D and FIGS. 19A-19F, FIGS. 20A-20F, FIGS. 21A-21F, and FIGS. 22A-22F, the assembly 11 comprises a universal magnet roller press 10 and a plurality of magnet roller adaptors 31*a*, 31*b*, 31*c*, 31*d*, and 64*a*, 64*b*. 17A-17D are illustrations of various views of the universal magnet roller press apparatus 10 of the disclosure. FIGS. 18A-18D are illustrations of various views of an existing magnet roller 12 that may be used with one of the embodiments of the universal magnet roller press apparatus 10, assembly 11, and method of the disclosure. FIGS. 19A-19F, FIGS. 20A-20F, FIGS. 21A-21F, and FIGS. 22A-22F are illustrations of various views of magnet roller adaptors 31*a*, 31*b*, 31*c*, 31*d*, and 64*a*, 64*b* for use with the universal magnet roller press apparatus 10 of FIGS. 17A-17D.

Figures 17A, 18A, 19A, 19B, 19C, 19D, 19E, 19F:
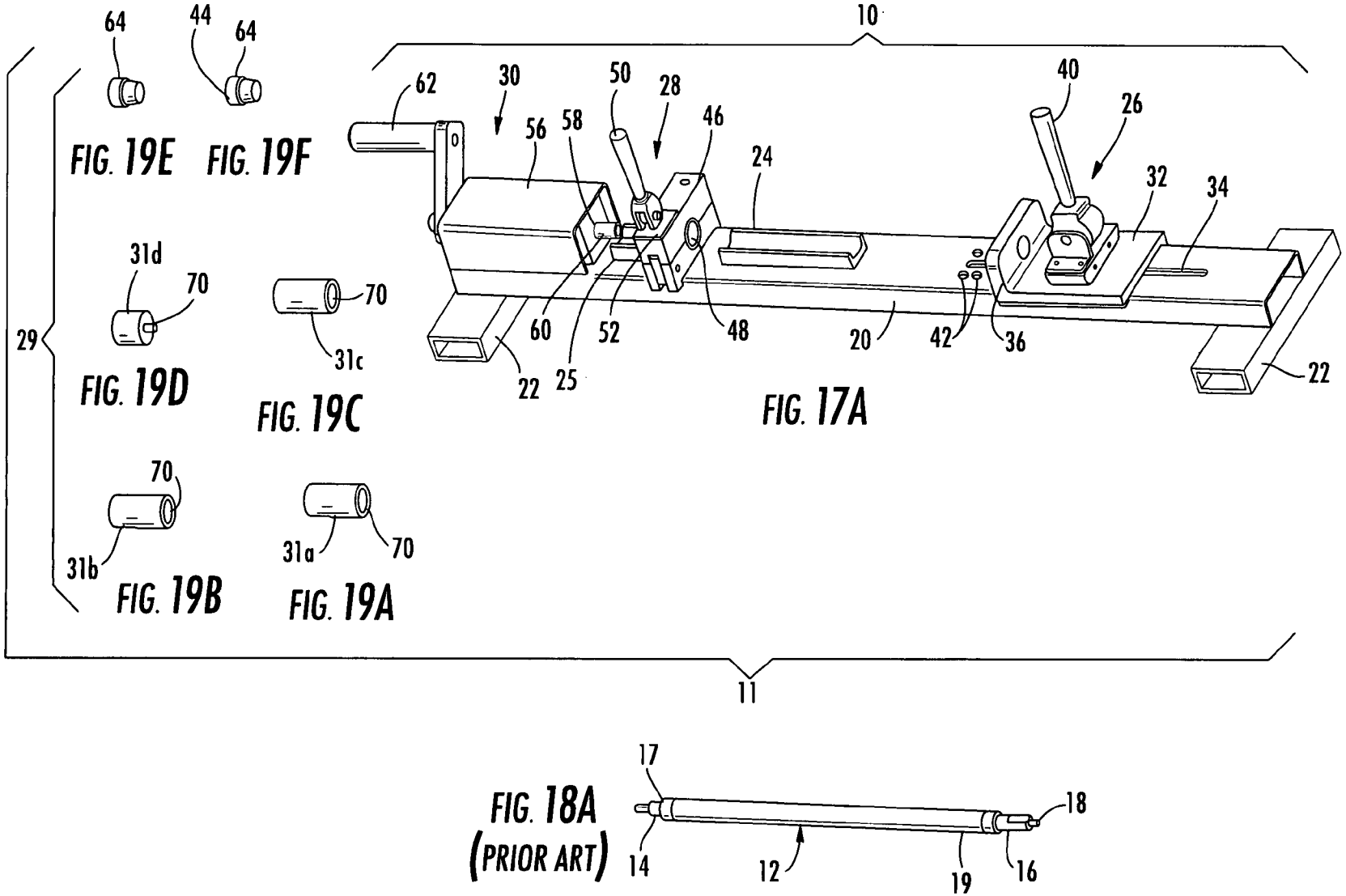
FIG. 18A (PRIOR ART)
FIGS. 17A-17D are illustrations of various views of another embodiment of a universal magnet roller press apparatus of the disclosure.
FIGS. 18A-18D are illustrations of various views of an existing magnet roller that may be used with one of the embodiments of the universal magnet roller press apparatus, assembly, and method of the disclosure.
FIGS. 19A-19F, FIGS. 20A-20F, FIGS. 21A-21F, and FIGS. 22A-22F are illustrations of various views of adaptors for use with the universal magnet roller press apparatus of FIGS. 17A-17D.

FIG. 17A-17D are illustrations of top front perspective views of the universal magnet roller press apparatus 10 of the disclosure. The universal magnet roller press apparatus 10 may be used with any number of existing magnet rollers such as an existing magnet roller 12 (see FIGS. 18A-18D). The magnet roller 12 has a first end 14 having a hub 17. The magnet roller 12 has a second end 16. The magnet roller 12 comprises a magnet 18, preferably an inner magnet, and a magnet sleeve 19. FIG. 17A is an illustration of a top perspective view of the apparatus 10. The apparatus 10 comprises a mounting base 20 with end pieces 22. Preferably, the mounting base is comprised of steel. The mounting base 20 has a first alignment block 24 and a second alignment block 25 attached to the top of the mounting base 20. The first alignment block 24 may be comprised of felt, plastic or another suitable material and is designed to cradle or hold the magnet roller 12 during the removal and installation process. The second alignment block 25 may be comprised of felt, plastic or another suitable material and is designed to cradle or hold universal magnet roller adaptors such as universal magnet roller adaptors 31*a*, 31*b*, 31*c*, 31*d*.

The apparatus 10 further comprises a rear slide lock or back support assembly 26 comprising a base portion 32 configured to slide along a slotted slide portion 34 formed in a top portion of the mounting base 20. The rear slide lock or back support assembly 26 is attached to a top end of the mounting base 20. The base portion 32 has a stop portion 36 with an opening 38 for insertion of one of the ends of the magnet roller depending on whether the magnet roller is undergoing removal or installation. The base portion 32 further comprises a locking handle 40 to lock the rear slide lock or back support assembly 26 in place. The rear slide lock or back support assembly 26 further comprises openings 42 on each side of an end 44 of the slotted slide portion 34 for locking the base portion 32 in place when it slides forward into a desired position.

The apparatus 10 further comprises a front lock magnet support or front support assembly 28 comprising a block portion 46 having an opening 48 for insertion of one of the ends of the magnet roller 12. The front lock magnet support or front support assembly 28 is attached to a top portion of the mounting base 20 and is spaced apart from the rear slide lock or back support assembly 26. The front lock magnet support or front support assembly 28 further comprises a front locking handle 50 on a steel pad 52 to lock the front lock magnet support or front support assembly 28 in place. The front lock magnet support or front support assembly 28 further comprises a stop portion 54 (see FIG. 17B) for stopping the magnet roller 12 in place.

The apparatus 10 further comprises a screw mechanism or screw drive assembly 30 comprising a housing cover 56, an opening 58 for insertion of a screw operated push rod 60. The screw mechanism or screw drive assembly 30 is attached to a top end of the mounting base 20 opposite the top end where the rear slide lock or back support assembly 26 is attached. The screw operated push rod 60 is designed to be inserted into the magnet roller end and remove a magnet roller hub 14. The screw mechanism or screw drive assembly 30 further comprises a revolving handle 62 for actuating the screw mechanism or screw drive assembly 30.

Figures 17B, 18B, 20A, 20B, 20C, 20D, 20E, 20F:
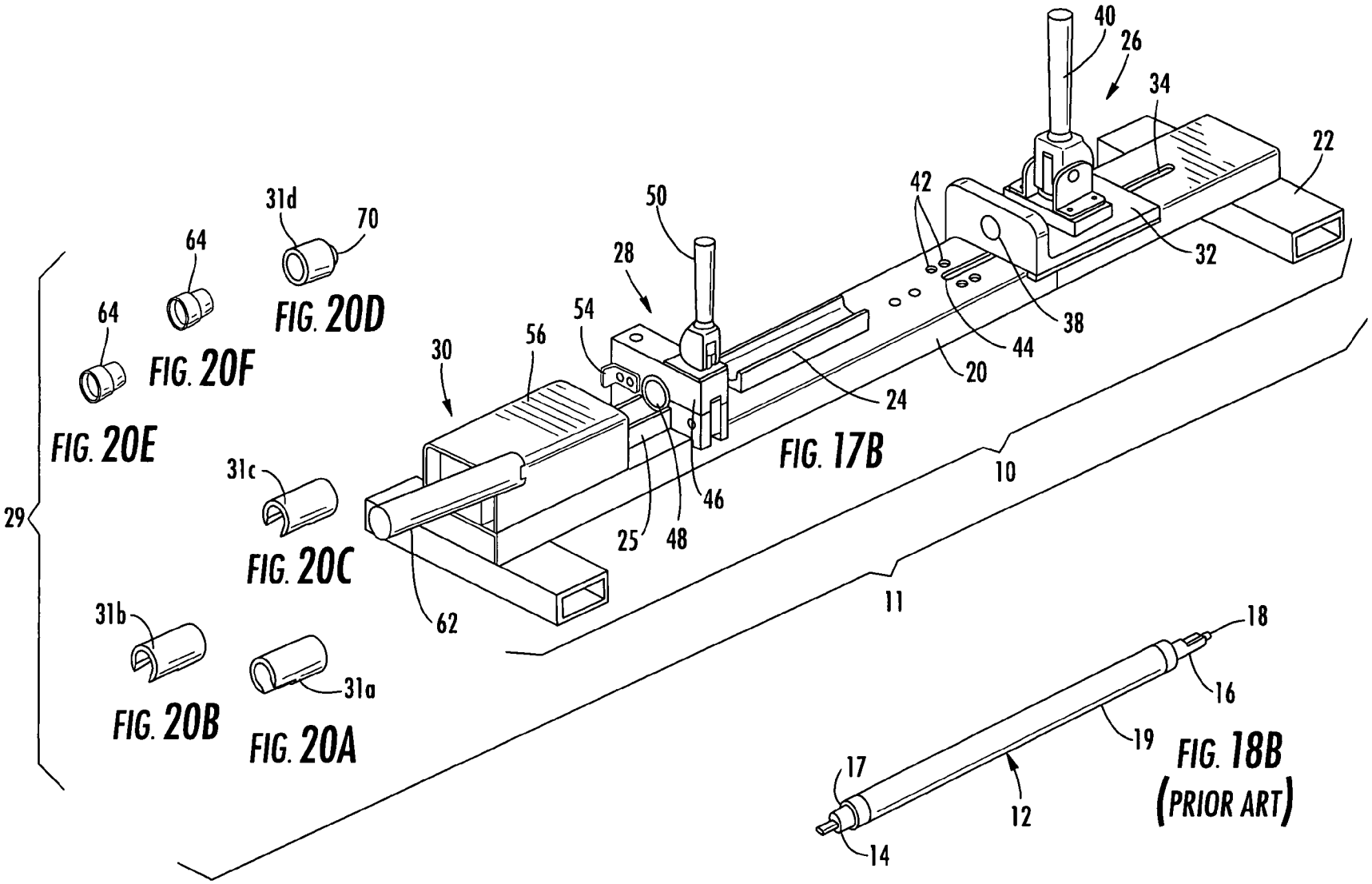
FIG. 18B (PRIOR ART)
Figures 17C, 18C, 21A, 21B, 21C, 21D, 21E, 21F:
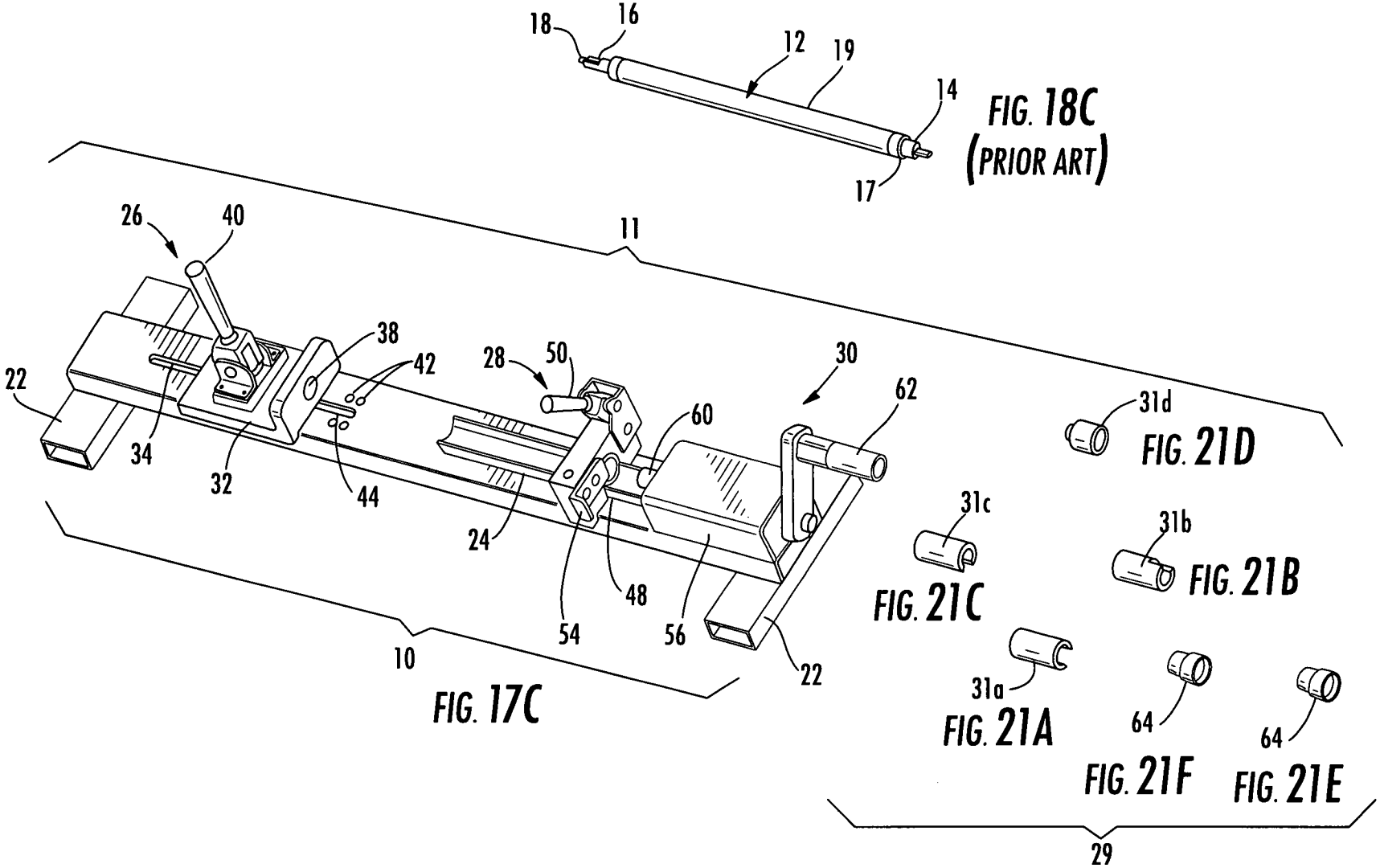
FIG. 18C (PRIOR ART)
Figures 17D, 18D, 22A, 22B, 22C, 22D, 22E, 22F:
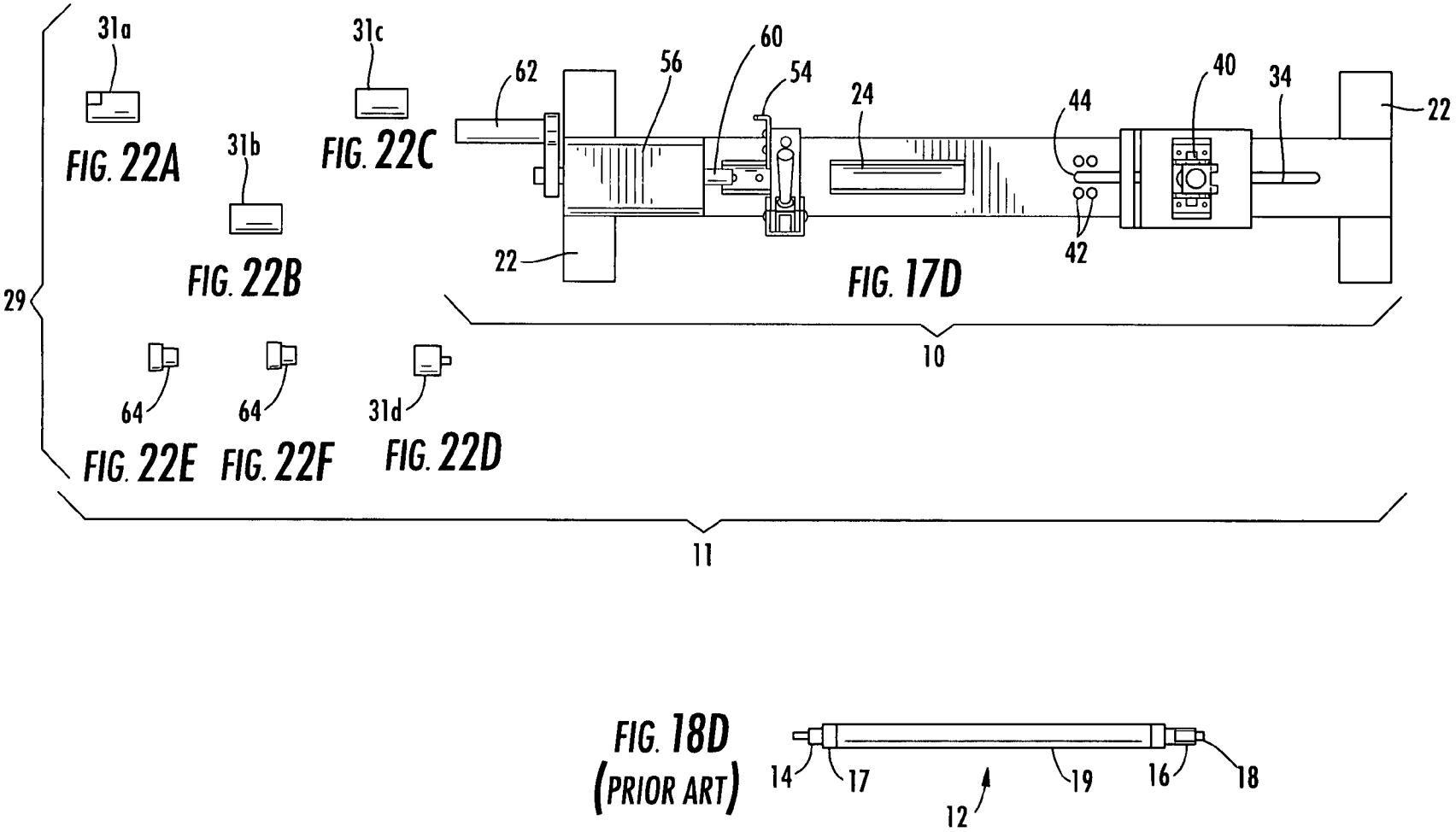
FIG. 18D (PRIOR ART)

The universal magnet roller press apparatus 10 may further comprise optional rear slide adaptor stop rings or magnet roller adaptors 64. The stop rings or magnet roller adaptors 64 may be of various sizes for various size magnet roller lengths. FIG. 17B is an illustration of a front right perspective view of the universal magnet roller press apparatus 10 of the disclosure. FIG. 17C is an illustration of a front left perspective view of the universal magnet roller press apparatus of the disclosure. FIG. 17D is an illustration of a top view of the universal magnet roller press apparatus 10 of the disclosure.

In another embodiment of the disclosure there is provided a method for replacing a magnet roller sleeve and possibly other components of a magnet roller. The method comprises the step of placing the magnet roller 12 on the first alignment block 24 with the first hub end 14 facing toward the rear slide lock 26. The method further comprises the step of pushing the stop portion 54 in front of the opening 48 of the rear slide lock 26. The method further comprises the step of inserting the magnet roller 12 with the second end 16 into the opening 48 of the rear slide lock 26 until it touches the stop portion 54. The method further comprises the step of aligning the first hub end 14, and in particular, the magnet sleeve non-coated portion, with the opening 38 of the rear slide lock 26. The method further comprises the step of locking the front locking handle 50. The method further comprises the step of turning the revolving handle 62 of the screw mechanism 30 counterclockwise to move or actuate the push rod 60 forward and continuing to turn revolving handle 62 until the hub 17 and the magnet 18 are pushed out of the first hub end 14 opening of the sleeve. Generally, the hub and a spring element (not shown) remain. The method further comprises the step of installing and replacing with a replacement magnet sleeve (see FIG. 16G). The method further comprises the step of positioning the existing removed hub 17 into an end 70 of one of the universal adaptors 31*a-d*. The apparatus is designed to be used with any number of suitable universal magnet roller adaptors. The method further comprises the step of placing one of the universal adaptors 31*a-d* with the removed hub 17 onto the push rod 60 so that it sits in the second alignment block 25. The magnet 18 is then manually placed or inserted into the new sleeve and may have the concentric spring on the hub end. The new sleeve is then positioned into the first alignment block 24. The stop portion 54 is pushed in front of the opening 48 of the front lock magnet support 28, and the rear slide adaptor stop rings 64 may be inserted into the opening 38 of the rear slide lock 26. The rear slide lock 26 may then be pushed forward onto the new sleeve until the forward sleeve lip touches the stop plate. The pins (not shown) of the rear slide lock 26 fall into place in the pin holes 42 of the mounting base 20. Once the pins are in place, the handle 40 can be actuated down and locked. The revolving handle 62 can be turned counterclockwise to move the push rod 60 forward and the hub adaptor until the hub 17 engages the new sleeve and mates the hub flange with sleeve. The screw operated push rod removes the magnet roller hubs and magnet rods and installs the removed hubs and magnet rods into new sleeves. The method allows a magnet roller to be taken apart and the universal magnet press is adapted to work with any size magnet roller. The front locking support is primarily used instead of the rear locking support to retain the magnet roller in place and make it easier to disassemble.

The above description sets forth, rather broadly, a summary of embodiments of the disclosure so that the detailed description that follows may be better understood and contributions of the disclosure to the art may be better appreciated. Some of the embodiments of the disclosure may not include all of the features or characteristics listed in the above summary. There may be, of course, other features of the disclosure that will be described below and may form the subject matter of claims. In this respect, before explaining at least one embodiment of the disclosure in detail, it is to be understood that the disclosure is not limited in its application to the details of the construction and to the arrangement of the components set forth in the following description or as illustrated in the drawings. The disclosure is capable of other embodiments and of being practiced and carried out in various ways.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting. Although specific terms are employed herein, they are used in a generic and descriptive sense only and for purposes of limitation. The disclosure is not limited in its application to the details of the construction and to the arrangement of the components set forth in the above description or as illustrated in the drawings.

What is claimed is:

1. A method for removing and installing a magnet and a hub of a magnet roller of a toner printer cartridge, the method comprising: using a universal magnet roller assembly to remove the magnet and the hub from the magnet roller; and, using the universal magnet roller assembly to install the removed magnet and the removed hub into a replacement magnet sleeve to form a remanufactured magnet roller wherein the universal magnet roller assembly comprises: a universal magnet roller press apparatus comprising: a mounting base; a screw drive assembly attached to a first top end of the mounting base; an alignment cradle attached to a top portion of the mounting base adjacent the screw drive assembly; a front support assembly attached to the top portion of the mounting base adjacent the alignment cradle; a back support assembly attached to a second top end of the mounting base and spaced apart from the front support assembly; and, a first rod stop and a second rod stop attached to sides of the mounting base for adjusting a position of the back support assembly; and, one or more magnet roller adaptors for attachment to the magnet roller during removal and installation of the magnet and the hub.

2. A method for remanufacturing a magnet roller of a toner printer cartridge, the method comprising:

providing a magnet roller having a first end, a second end, a hub attached at the first end, a magnet sleeve, and an inner magnet;

coupling a first magnet roller adaptor to the first end of the magnet roller;

providing a universal magnet roller press comprising:

a screw drive assembly having a revolving handle and a push rod;

a front support assembly; and, a back support assembly;

positioning and aligning the magnet roller in the front support assembly and the back support assembly of the universal magnet roller press apparatus;

using the screw drive assembly to push the inner magnet and the hub out of the magnet sleeve;

removing the first magnet roller adaptor;

discarding the magnet sleeve;

inserting the removed inner magnet and the removed hub into a replacement magnet sleeve having a first end and a second end;

coupling a second magnet roller adaptor to the first end of the replacement magnet sleeve and coupling a third magnet roller adaptor to the second end of the replacement magnet sleeve;

positioning and aligning the replacement magnet sleeve in the front support assembly and the back support assembly of the universal magnet roller press apparatus;

using the screw drive assembly to attach the removed inner magnet and the removed hub to the replacement magnet sleeve to form a remanufactured magnet roller; and, removing the second magnet roller adaptor and the third magnet roller adaptor from the remanufactured magnet roller.

3. The method of claim 2, wherein the screw drive assembly comprises:

a block body;

a revolving handle attached to the block body;

a push rod positioned within the block body; and, an elongated screw coupled to the push rod and attached to the revolving handle; wherein the revolving handle actuates the elongated screw to engage the push rod out of the block body such that the push rod pushes the magnet and the hub into and out of the magnet roller during removal and installation of the magnet and the hub.

4. The method of claim 2, wherein the front support assembly comprises:

a top part;

a bottom part;

a connector part that connects the top part to the bottom part via attachment element; and, a latch component attached to the top part and coupled to a locking clamp handle, wherein the front support assembly holds the magnet roller in place during removal and installation of the magnet and the hub.

5. The method of claim 2, wherein the back support assembly comprises:

a pair of side plates having hook end portions;

a center block component attached between the pair of side plates, the center block component having a U-shaped back support slot; and, a slide retainer bracket coupled to the pair of side plates, wherein the back support assembly holds one end of the magnet roller in place during removal and installation of the magnet and the hub.

6. The method of claim 2, wherein the magnet roller is a worn magnet roller with a worn magnet sleeve.

7. A method for removing and installing a magnet and a hub of a magnet roller of a toner printer cartridge used in electrophotographic image forming devices, the method comprising: removing a magnet and a hub from a magnet roller by: positioning and aligning the magnet roller in a universal magnet roller press apparatus, the universal magnet roller press apparatus comprising: a mounting base; a screw drive assembly attached to a first top end of the mounting base; an alignment cradle attached to a top portion of the mounting base adjacent the screw drive assembly; a front support assembly attached to the top portion of the mounting base adjacent the alignment cradle; a back support assembly attached to a second top end of the mounting base and spaced apart from the front support assembly; and, a first rod stop and a second rod stop attached to sides of the mounting base for adjusting a position of the back support assembly.; actuating with a revolving handle a push rod of the screw drive assembly to push the magnet and the hub out of a magnet sleeve; discarding the magnet sleeve; installing the removed magnet and the removed hub into a replacement magnet sleeve by: inserting the removed magnet and the removed hub into the replacement magnet sleeve; positioning and aligning the removed magnet and the removed hub within the replacement magnet sleeve in the universal magnet roller press apparatus; actuating with the revolving handle the push rod of the screw drive assembly to push the removed magnet and the removed hub into the replacement magnet sleeve so that the removed magnet and the removed hub attach to the replacement magnet sleeve; and, removing the attached magnet roller from the universal magnet roller press apparatus.

8. The method of claim 7, wherein the magnet roller is a worn magnet roller with a worn magnet sleeve.

9. The method of claim 7, wherein the method allows for securement of the magnet roller during removal and installation of the magnet and hub to avoid damage to the magnet and hub.

10. The method of claim 7, wherein the method allows for proper alignment of the magnet roller during removal and installation of the magnet and hub.

* * * * *